United States Patent [19]

Nakaniwa

[11] Patent Number: 4,883,038

[45] Date of Patent: Nov. 28, 1989

[54] FUEL SUPPLY CONTROL SYSTEM FOR MULTI-CYLINDER INTERNAL COMBUSTION ENGINE WITH FEATURE OF SUPPRESSION OF OUTPUT FLUCTUATION BETWEEN INDIVIDUAL ENGINE CYLINDERS

[75] Inventor: Shinpei Nakaniwa, Isezaki, Japan

[73] Assignee: Japan Electronic Control Systems Co., Ltd., Isezaki, Japan

[21] Appl. No.: 115,371

[22] Filed: Nov. 2, 1987

[30] Foreign Application Priority Data

| | | | |
|---|---|---|---|
| Oct. 31, 1986 | [JP] | Japan | 61-258488 |
| Dec. 23, 1986 | [JP] | Japan | 61-305350 |
| Aug. 12, 1987 | [JP] | Japan | 62-200047 |

[51] Int. Cl.[4] ..... F02D 41/26

[52] U.S. Cl. ..... 123/436

[58] Field of Search ..... 123/419, 436, 438; 364/431.08

[56] References Cited

U.S. PATENT DOCUMENTS

| | | | |
|---|---|---|---|
| 4,366,793 | 1/1983 | Coles | 123/438 X |
| 4,475,511 | 10/1984 | Johnson et al. | 123/436 |
| 4,509,484 | 4/1985 | Gertiser | 123/436 |
| 4,562,812 | 1/1986 | Chauvel | 123/417 |
| 4,562,817 | 1/1986 | Ito | 123/478 |
| 4,683,856 | 8/1987 | Matsuura et al. | 123/419 X |
| 4,697,561 | 10/1987 | Citron | 123/436 X |

*Primary Examiner*—Willis R. Wolfe

*Attorney, Agent, or Firm*—Foley & Lardner, Schwartz, Jeffery, Schwaab, Mack, Blumenthal & Evans

[57] ABSTRACT

A fuel supply control system is specifically adapted for an internal combustion engine which performs multi-point injection to supply fuel to respective engine cylinders at mutually independent timing. The combustioning condition in each cylinder is monitored to detect occurrence of fluctuation of combustioning conditions exceeding a predetermined magnitude for initiating fuel delivery amount correction, for compensating fluctuation of engine speed, which is caused by fluctuation of combustioning conditions among the individual engine cylinders.

34 Claims, 15 Drawing Sheets

FUEL SUPPLY CONTROL SYSTEM FOR MULTI-CYLINDER INTERNAL COMBUSTION ENGINE WITH FEATURE OF SUPPRESSION OF OUTPUT FLUCTUATION BETWEEN INDIVIDUAL ENGINE CYLINDERS

BACKGROUND OF THE INVENTION

1. Field of the Invention

The present invention relates generally to a fuel supply control system for a multi-cylinder internal combustion engine. More specifically, the invention relates to a fuel supply control system which can adjust a fuel supply amount for respective engine cylinders for suppressing fluctuation of the outputs of respective cylinders, thereby suppressing engine speed fluctuation in each engine revolution cycle, for better engine driveability.

2. Description of the Background Art

The U.S. Pat. No. 4,562,817, issued on Jan. 7, 1986 discloses a so-called multi-point fuel injection internal combustion engine which is designed for injecting a controlled amount of fuel for each individual cylinder at mutually independently controlled timing. Such a multi-point fuel injection-type internal combustion engine generally exhibits good and precise response characteristics for variation of the load since precise fuel injection amount control can be performed with respect to each of individual engine cylinders.

However, on the other hand, such a multipoint fuel injection system for the internal combustion engine has a drawback in causing fluctuation in outputs of respective cylinders when fuel injection characteristics at respective fuel injection valves for respective engine cylinders vary due to secular change, for example. This causes variation of fuel distribution for respective engine cylinders to cause fluctuation of the engine speed during each engine revolution cycle. This clearly degrades engine driveability and engine idling stability and causes surging and so forth.

Furthermore, such output fluctuation among respective individual engine cylinders tends to cause degradation of engine performance and fuel economy. In the worse case, fluctuation of fuel delivery for respective engine cylinders may cause fluctuation of exhaust characteristics in each engine revolution cycle to damage a catalyst converter in an exhaust system.

SUMMARY OF THE INVENTION

Therefore, it is a primary object of the present invention to provide a fuel supply control system which can suppress fluctuation of the outputs of respective individual engine cylinders during engine revolution cycles and thereby provide satisfactory engine driving stability.

A fuel supply control system of the invention is specifically adapted for an internal combustion engine which performs multi-point injection of supply fuel to respective engine cylinders at mutually independent timing. The combustioning condition in each cylinder is monitored to detect occurrence of fluctuation of a combustioning condition exceeding a predetermined magnitude for initiating fuel delivery amount correction for compensating fluctuation of engine speed which is caused by fluctuation of the combustioning conditions between the individual engine cylinders.

According to one aspect of the invention, a fuel supply control system for an internal combustion engine which has a plurality of engine cylinders, comprises first means for delivering a controlled amount of fuel for respective engine cylinders at mutually independent and controlled timing, second means for monitoring a preselected engine driving condition and producing an engine driving condition indicative signal, third means for deriving the fuel delivery amount for a respective engine cylinder on the basis of the value of the engine driving condition indicative signal, fourth means for monitoring engine speed variation for detecting fluctuation of combustioning conditions between respective engine cylinders, fifth means, responsive to the fluctuation of the combustioning condition in excess of a predetermined magnitude, to derive a correction value for correcting the fuel delivery amount based thereon, and sixth means for controlling the first means at the controlled timing for delivering the fuel in the controlled amount corresponding to the fuel delivery amount corrected by the fifth means.

According to another aspect of the invention, a fuel supply control system for an internal combustion engine which has a plurality of engine cylinders, comprises first means for delivering a controlled amount of fuel for respective engine cylinders at mutually independent and controlled timing, second means for monitoring a preselected engine driving condition and producing an engine driving condition indicative signal, third means for deriving a fuel delivery amount for a respective engine cylinder on the basis of the value of the engine driving condition indicative signal, fourth means for monitoring engine speed variation for detecting fluctuation of combustioning conditions between respective engine cylinders, fifth means, responsive to the fluctuation of the combustioning condition in excess of a predetermined magnitude, to derive a first correction value for correcting the fuel delivery amount for one of the engine cylinders, based thereon, sixth means for deriving a second correction value for correcting the fuel delivery amount for other engine cylinders, and seventh means for controlling the first means at the controlled timing for delivering the fuel in the controlled amount corresponding to the fuel delivery amount corrected by the fifth means.

According to a further aspect of the invention, a fuel supply control system for an internal combustion engine which has a plurality of engine cylinders, comprises first means for delivering a controlled amount of fuel for respective engine cylinders at mutually independent and controlled timing, second means for monitoring a preselected engine driving condition and producing an engine driving condition indicative signal, third means for deriving a fuel delivery amount for respective engine cylinders on the basis of the value of the engine driving condition indicative signal, fourth means for monitoring engine speed variation for detecting fluctuation of combustioning conditions between respective engine cylinders, fifth means, responsive to the fluctuation of the combustioning condition in excess of a predetermined magnitude, to derive a correction value for correcting the fuel delivery amount based thereon, and sixth means for comparing the correction value with a predetermined threshold value for disabling derivation of the correction value when the correction value becomes greater than or smaller than the predetermined threshold value, and seventh means for controlling the first means at the controlled timing for delivering the fuel in the controlled amount corresponding to the fuel delivery amount corrected by the fifth means.

According to a still further aspect of the invention, a fuel supply control system for an internal combustion engine which has a plurality of engine cylinders, comprises first means for delivering a controlled amount of fuel for respective engine cylinders at mutually independent and controlled timing, second means for monitoring a preselected engine driving condition and producing an engine driving condition indicative signal, third means for deriving a fuel delivery amount for respective engine cylinders on the basis of the value of the engine driving condition indicative signal, fourth means for monitoring engine speed variation for detecting fluctuation of combustioning conditions between respective engine cylinders, fifth means, responsive to the fluctuation of the combustioning condition in excess of a predetermined magnitude, to derive a first correction value for correcting the fuel delivery amount for one of the engine cylinders, based thereon, sixth means for deriving a second correction value for correcting the fuel delivery amount for other engine cylinders, seventh means for comparing the correction value with a predetermined threshold value for disabling derivation of the correction value when the correction value becomes greater than or smaller than the predetermined threshold value, and eighth means for controlling the first means at the controlled timing for delivering the fuel in the controlled amount corresponding to the fuel delivery amount corrected by the fifth means.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiments but are for explanation and understanding only.

In the drawings.

DESCRIPTION OF THE PREFERRED EMBODIMENTS

Figure 1:
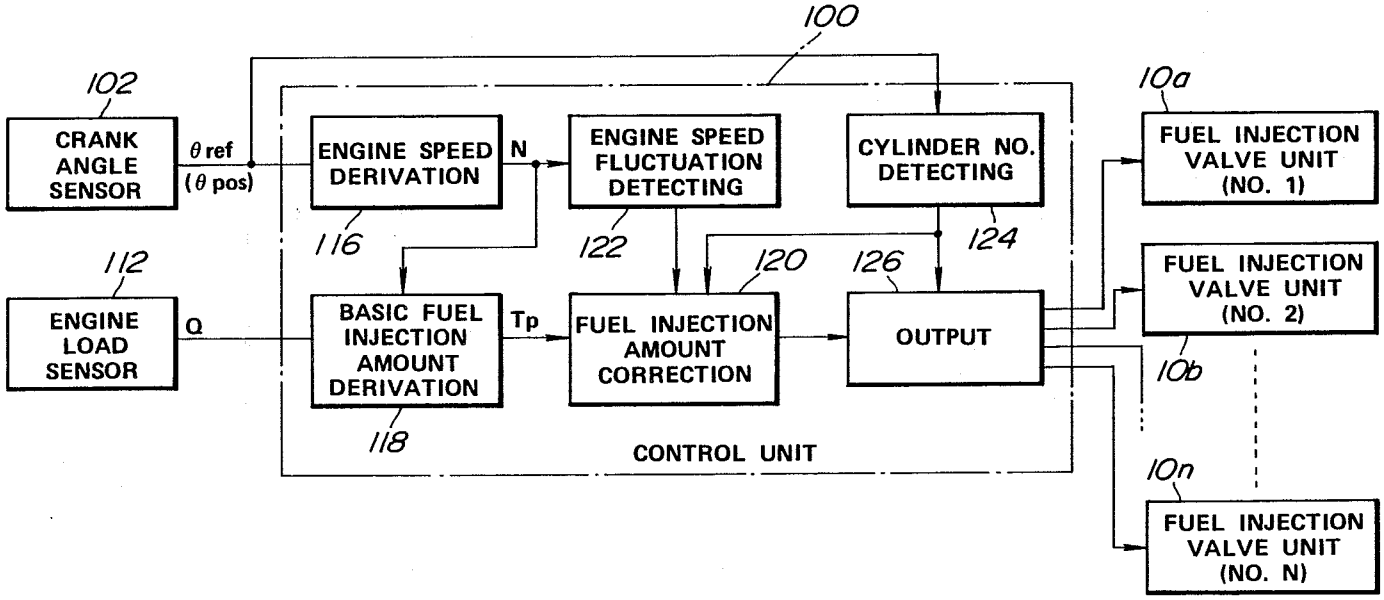
FIG. 1 is an explanatory and schematic block diagram of the first embodiment of a fuel injection control system, according to the present invention, which shows the construction of the first embodiment of the fuel injection control system with functional blocks.
Figure 2:
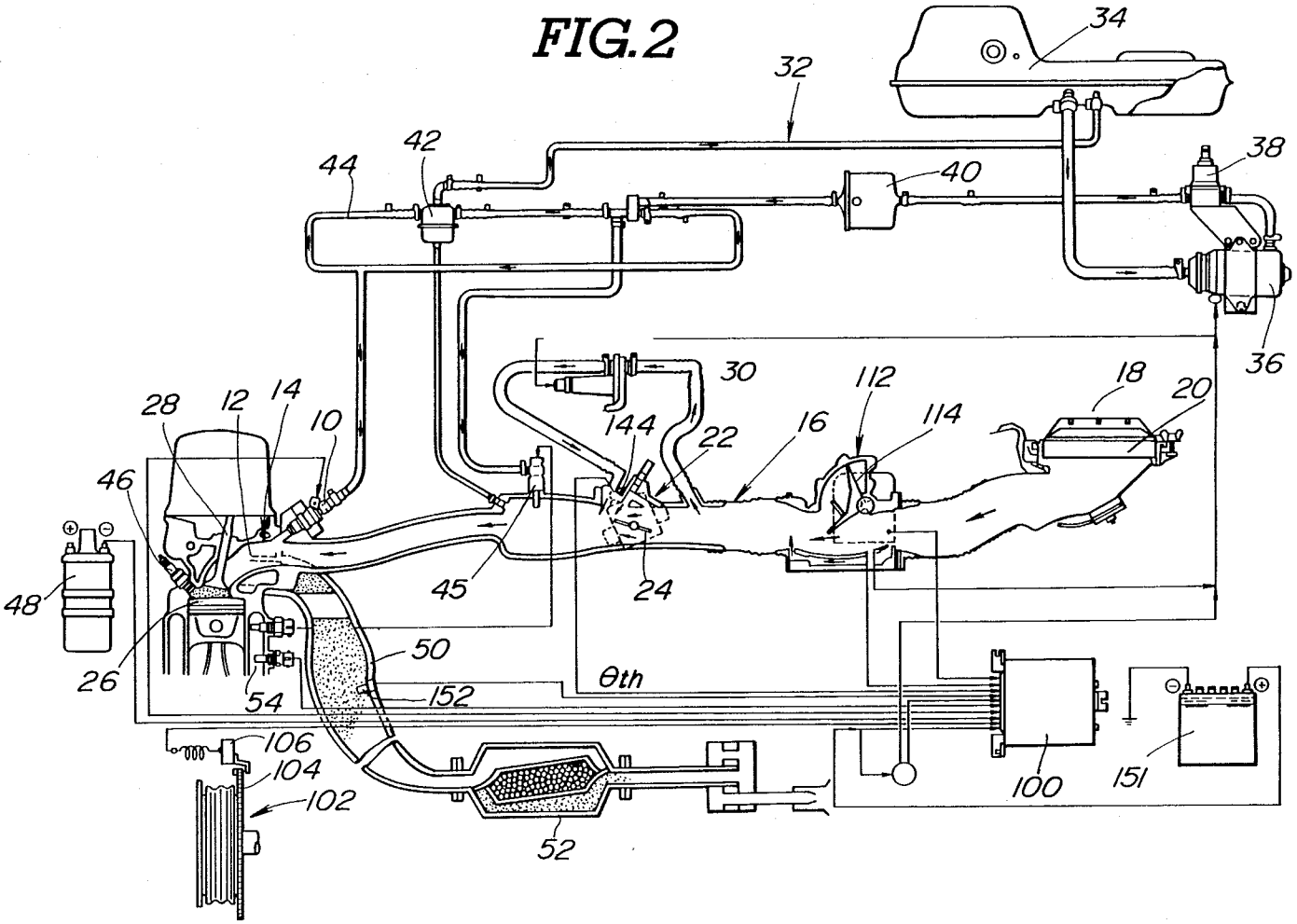
FIG. 2 is a diagrammatical illustration of an internal combustion engine, to which the first embodiment of the fuel injection control system of FIG. 1 is applicable.

Referring now to the drawings, particularly to FIGS. 1 and 2, the first embodiment of a fuel injection control system, as an example of implementation of a fuel supply control system according to the present invention, is designed for controlling a fuel injection amount and fuel injection timing for a multi-cylinder internal combustion engine so that fuel injection for each individual engine cylinder is controlled independently of that for other engine cylinders. For performing fuel injection at a controlled fuel amount and at a controlled injection timing, the internal combustion engine is provided with a plurality fuel injection valves 10*a*, 10*b* . . . 10*n*, which will be represented by the reference numeral '10' when generally referred to. Each fuel injection valve 10*a*, 10*b* . . . 10*n* is designed to be directed to each branch 12 of intake manifold 14 of an air induction system 16 which includes an air intake 18, an air cleaner 20, a throttle chamber 22 disposed therein a throttle valve 24 and the intake manifold 14. Each branch 12 of the intake manifold 12 is designed to introduce air/fuel mixture into one of the engine cylinders 26 defining a combustion chamber, via an inlet valve 28. As is well known, the induction system 16 also includes a bypass passage 30 bypassing the throttle chamber 22 for introducing intake air into the engine combustion chamber while the throttle valve is in a fully closed position.

In the alternative, the fuel injection valve may be provided for directly injecting the fuel into the associated combustion chamber. Therefore, the position of the fuel injection valve should not be regarded as essential matter to the present invention.

The fuel injection valves 10*a*, 10*b* . . . 10*n* are connected to a pressurized fuel supply system 32 including a fuel tank 34, a fuel pump 36, a fuel damper 38, a fuel filter 40, a pressure regulator 42 and a gallery 44. As shown in FIG. 2, the fuel supply system may also be connected to a cold start valve 45 disposed in the air intake duct downstream of the throttle chamber.

An ignition plug 46 is inserted into each combustion chamber to initiate combustion in the combustion chamber at a controlled timing. So as to perform spark ignition, the ignition plug 46 is connected to an ignition system including an ignition coil 48, a distributor (not shown) and so forth. The engine also has an exhaust system including an exhaust port closed by means of an exhaust valve (not shown), an exhaust duct 50, and a catalytic converter 52 for exhausting exhaust gas created by combustion of the air/fuel mixture in the combustion chamber.

Figure 4:
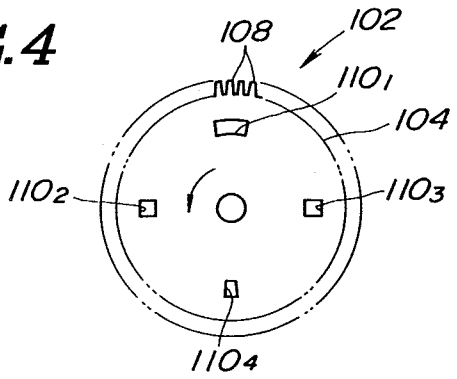
FIG. 4 is an explanatory illustration of one example of a crank angle sensor to be employed in the first embodiment of the fuel injection control system of FIG. 3.

A control unit 100 is provided for controlling fuel delivery and fuel injection timing depending upon the engine driving condition. In order to detect the engine driving condition and thereby derive the fuel delivery amount and fuel injection timing, the control unit 100 is connected to a crank angle sensor 102 which monitors a crank shaft angular position to produce a crank reference signal $\theta_{re}$ at every predetermined angular position of the crank shaft, e.g., 70° before top dead center (BTDC) of respective engine cylinders, and a crank position signal $\theta_{pos}$ at every given angular displacement, e.g., 2°, of the crank shaft. The crank angle sensor 102 comprises a rotary disc 104, and a photoelectric sensor 106. The rotary disc 104 is cooperatively associated with a crank shaft, so that the rotary disc 104 rotates a half revolution in synchronization with the crank shaft whenever the crank shaft rotates one revolution. As shown in FIG. 4, the rotary disc 104 is formed with a plurality of slits 108 and openings $\mathbf{110_1}$, $\mathbf{110_2}$, $\mathbf{110_3}$ and $\mathbf{110_4}$. The slits 108 are formed along the circumference of the disk 104 at regular angular intervals corresponding to given shaft angular positions, e.g., 2° or 1°. On the other hand, the openings $\mathbf{110_1}$, $\mathbf{110_2}$, $\mathbf{110_3}$ and $\mathbf{110_4}$ are oriented at respectively predetermined crank shaft angular positions, e.g., 70° BTDC of respectively corresponding engine cylinders. In the shown embodiment, since the crank angle sensor 102 is designed for monitoring the crank shaft angular position of a 4-cylinder engine, the opening $\mathbf{110_1}$ is oriented at the position corresponding the crank shaft angular position of 70° BTDC of No. 1 cylinder. Similarly, the openings $\mathbf{110_2}$, $\mathbf{110_3}$ and $\mathbf{110_4}$ are respectively oriented at the crank shaft angular positions of 70° BTDC of No. 2, No. 3 and No. 4 cylinders.

Figure 5:
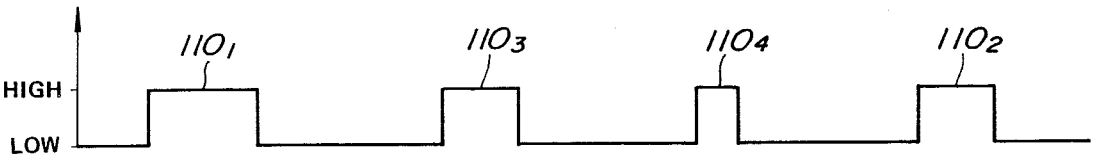
FIGS. 5(A) and 5(B) show waveforms of a crank reference signal and a crank position signal to be produced by the crank angle sensor of FIG. 4.
Figure 5:
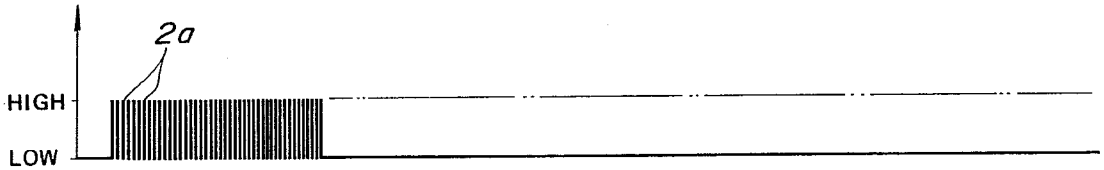

As seen from FIG. 4, the openings $\mathbf{110_1}$, $\mathbf{110_2}$, $\mathbf{110_3}$ and $\mathbf{110_4}$ are of different circumferential length. Namely, the opening $\mathbf{110_1}$ corresponding to the No. 1 cylinder has the longest circumferential length and the opening $\mathbf{110_3}$ and $\mathbf{110_4}$ are provided with the smallest circumferential length. Therefore, as seen from FIG. 5(A), the pulse width of the crank reference signal $\theta_{ref}$ to be produced varies depending upon the particular cylinders reaching the 70° BTDC. On the other hand, since the slots 108 are provided with even width, the crank position signal $\theta_{pos}$ has substantially short and constant pulse width.

Returning to FIGS. 1 and 2, the control unit 100 is also connected to an engine load sensor 112 monitoring load on the engine to produce an engine load indicative signal. As is well known, the engine load sensor 112 generally comprises an air flow meter 114 measuring intake air flow rate to produce an air flow rate indicative signal Q.

The control unit 100 includes an engine speed derivation stage 116 which is active at every occurrence of the crank reference signal and in response to the every crank reference signal for deriving an engine revolution speed on the basis of an interval between occurrence of the crank reference signals $\theta_{ref}$. Namely, the engine speed derivation stage 116 measures an elapsed period from occurrence of the crank reference signal $\theta_{ref}$ to the next occurrence of the crank reference signal. The engine speed derivation stage 116 obtains the reciprocal of the crank reference signal interval as an engine speed representative data N.

The engine speed representative data N is fed to a basic fuel injection amount derivation stage 118. The basic fuel injection amount derivation stage 118 also receives the engine load indicative signal Q as an engine load data. Based on the received basic fuel injection parameters, i.e. engine speed data N and the engine load data Q, the basic fuel injection amount derivation stage 118 derives a basic fuel injection amount Tp according to the following equation:

$$Tp = K \times Q/N$$

where K is a constant.

The basic fuel injection amount derivation stage 118 outputs a derived basic fuel injection amount indicative data Tp to a fuel injection amount correction stage 120. The fuel injection amount correction stage 120 corrects the basic fuel injection amount Tp based on various correction parameters such as an engine coolant temperature Tw, oxygen concentration in the exhaust gas, and the throttle valve angular position. Namely, the fuel injection amount derivation stage 118 performs cold engine enrichment, engine start-up enrichment, acceleration enrichment and so forth. Therefore, in the normal case, the fuel injection amount correction stage 120 derives a fuel injection amount Ti according to the following equation:

$$Ti = Tp \times COEF \times \alpha + Ts$$

where

COEF = 1 + Ktw + Kas + Kacc + Kmr;

Ktw: engine coolant dependent fuel enrichment coefficient;

Kas: engine start-up enrichment coefficient;

Kacc: acceleration enrichment coefficient;

Kmr: air/fuel mixture ratio dependent correction coefficient;

Ts: vehicular voltage dependent correction coefficient; and $\alpha$ $\lambda$ control correction coefficient which is derived based on $O_2$ concentration in the exhaust gas.

The fuel injection amount correction stage 120 further performs correction of the fuel injection amount on the basis of engine speed fluctuation in respective combustioning engine cylinders. In order to enable, the engine speed fluctuation suppressive fuel injection amount correction, the control unit 100 includes an engine speed fluctuation detecting stage 122. The engine speed fluctuation detecting stage 122 receives the engine speed data N from the engine speed derivation stage 116. The engine speed fluctuation detecting stage 122 compares the engine speed data $N_1$ derived in response to one crank reference signal with an engine speed data $N_2$ derived in response to the next crank reference signal to determine a difference $\Delta N$. This engine speed difference data $\Delta N$ is taken as fluctuation indicative data indicative of output fluctuation between succeedingly combustioned engine cylinders.

The fuel injection amount correction stage 120 receives the engine speed difference data $\Delta N$ from the engine speed fluctuation detecting stage 122 as combustioning fluctuation correction data. As will be appreciated, fuel injection timing and the combustioning timing in one engine cylinder is different from each other.

Namely, in the case of the 4-cycle engine, fuel injection is to be performed around top dead center (TDC) of the corresponding engine cylinder in the induction stroke and combustion is to take place at around TDC in the compression stroke. When combustion of the engine is to be performed in the order of No. 1-No. 3-No. 4-No. 2 cylinders, the TDC in the induction stroke of the No. 1 cylinder corresponds to TDC in the compression stroke of No. 4 cylinder, for example. Therefore, the engine speed difference data ΔN from the engine speed fluctuation detecting stage 122 is temporarily stored for use in derivation of the fuel injection amount for the next occurrence of the fuel injection for the corresponding engine cylinder in the fuel injection amount correction stage 120.

In order to detect the cylinder number to perform fuel injection, the control unit 100 includes a cylinder number detecting stage 124 which receives the crank reference signal $\theta_{ref}$ from the crank angle sensor 102. Since the crank reference signal $\theta_{ref}$ indicates 70° BTDC of one engine cylinder in the compression stroke, the cylinder to perform fuel injection are the two next cylinders. The corresponding cylinders to perform fuel injection in the 4-cylinder engine which performed combustion in the aforementioned order will be seen from the following table.

| Cylinder No. (Induction) | Cylinder No. (Compression) |
|---|---|
| 1 | 4 |
| 3 | 2 |
| 4 | 1 |
| 2 | 3 |

Therefore, according to the aforementioned schedule, the cylinder number detecting stage 124 detects the cylinder number to perform the fuel injection. In detection of the cylinder numbers, the crank reference signals $\theta_{ref}$ having mutually different pulse width will provide information concerning the cylinder number.

The cylinder number detecting stage 12 thus outputs cylinder number indicative data to the fuel injection amount correction stage 120 as a data identifying the cylinder to calculate the fuel injection amount. Based on this cylinder number indicative data, the fuel injection amount correction stage performs calculation of the fuel injection amount on the basis of the engine speed difference data ΔN. The corrected fuel injection amount data in the fuel injection amount correction stage 120 is fed to an output stage 126. To the output stage 126, the cylinder number indicative data from the cylinder number detecting stage 124 is also input. In the output stage 126, the fuel injection amount data is converted into a pulse form fuel injection signal having a pulse width corresponding to the fuel amount to be injected through the corresponding one of fuel injection 7 valves 10*a*, 10*b* . . . 10*n*.

As will be appreciated herefrom, since the first embodiment of the fuel injection control system can determine the fuel injection amount for each cylinder in such a manner that the engine speed difference ΔN which represents fluctuation of combustioning condition in succeedingly combustioned engine cylinders, is reduced to zero, the engine revolution cycle becomes smoother to provide substantially improved driving characteristics.

Figure 3:
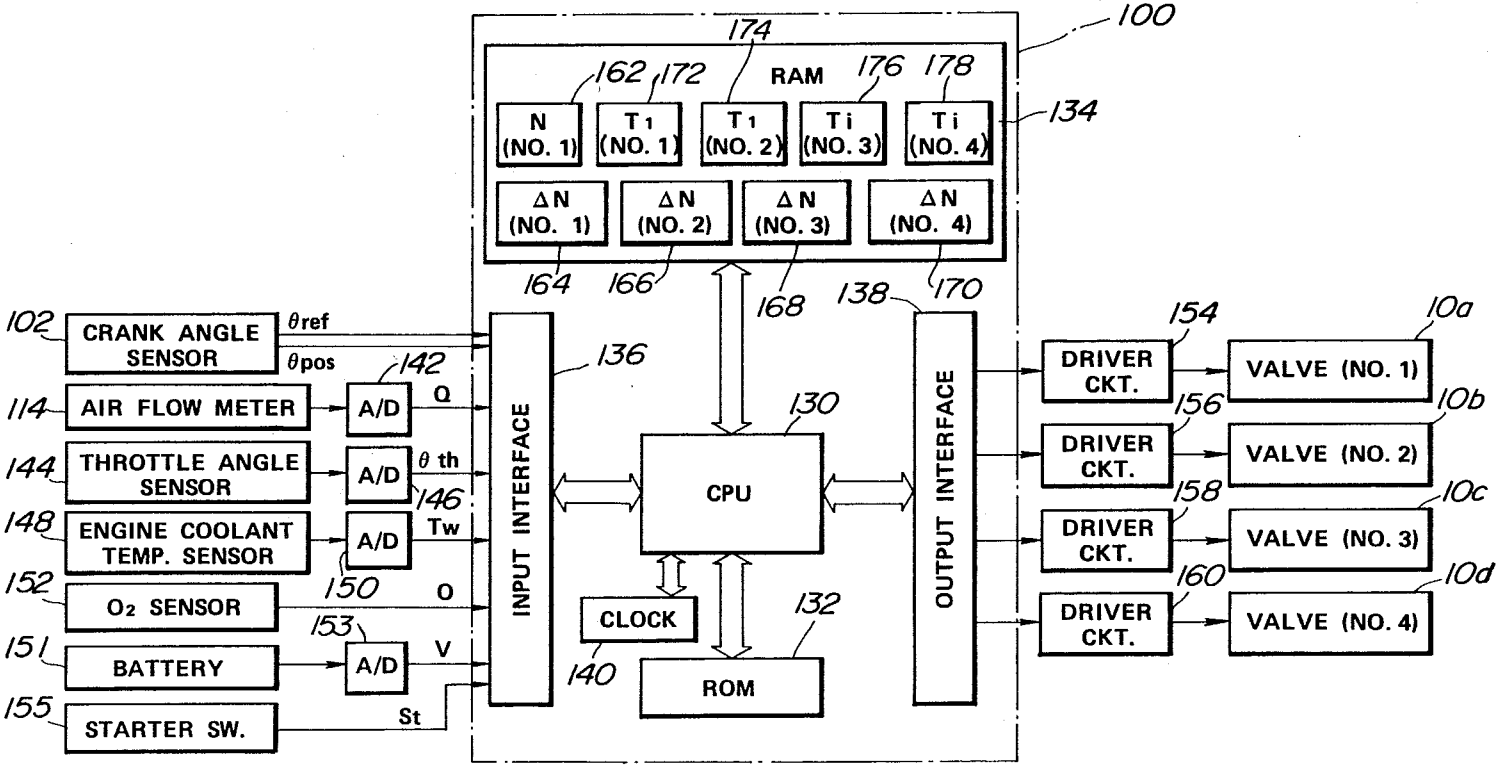
FIG. 3 is a block diagram showing detail of the first embodiment of the fuel injection control system of FIG. 1.

The practical construction of the aforementioned first embodiment of the fuel injection control system will be disclosed herebelow with reference to FIGS. 2 and 3. As will be seen from FIG. 3, the control unit 100 to be employed in the shown embodiment is a microprocessor based system including CPU 130, ROM 132, RAM 134, an input interface 136 and an output interface 138. The control unit 100 may also include an internally facilitated clock generator 140. The input interface 136 is connected to the aforementioned crank angle sensor 102 and the air flow meter 114. As seen from FIG. 2, when a flap-type air flow meter is employed which produces an analog air flow rate indicative signal, an analog-to-digital (A/D) converter 142 may be interposed between the air flow meter 114 and the input interface 136 so as to input a digital form air flow rate indicative signal Q. The shown fuel injection control system further employs a throttle angle sensor 144 which monitors throttle valve angular position to produce a throttle angle indicative signal θth. Since the throttle angle sensor 144 generally comprises a potentiometer producing an analog form throttle angle indicative signal, an A/D converter 146 may be interposed between the throttle angle sensor 144 and the input interface 136. An engine coolant temperature sensor 148 is disposed within an engine coolant chamber 54 (FIG. 2) for monitoring an engine coolant temperature Tw. The engine coolant temperature sensor 148 outputs an engine coolant temperature indicative signal Tw to the input interface 136 via an A/D converter 150. In addition, an $O_2$ sensor 152 is disposed within the exhaust passage 50 to monitor oxygen ($O_2$) concentration in the exhaust gas. The $O_2$ sensor outputs an $O_2$ concentration indicative signal 0 to the input interface 136. A vehicular battery 151 is also connected to the input interface 136 via an A/D converter 153.

On the other hand, the output interface 138 is connected to driver circuits 154, 156, 158 and 160 respectively designed for driving the fuel injection valves 10*a*, 10*b*, 10*c* and 10*d* for respective No. 1, No. 2, No. 3 and No. 4 engine cylinders.

Based on the engine coolant temperature indicative signal Tw, cold engine enrichment correction can be performed when the engine coolant temperature is lower than a predetermined reference temperature. Similarly, based on variation of the throttle angle indicative signal $\theta_{th}$ and the variation of speed, the acceleration enrichment correction for the fuel injection amount can be performed when the variation magnitude and/or variation speed of the throttle angle exceeds a predetermined threshold value. Air/fuel mixture rate dependent control and Ramda control may be performed based on the input from the $O_2$ sensor. Weak battery correction may also be performed when the vehicular battery voltage becomes lower than a given voltage. Furthermore, engine starting enrichment may be performed in response to a HIGH level signal of a starter switch 155.

In addition to the aforementioned corrections, the first embodiment of the fuel injection control system performs combustioning condition dependent fuel injection amount correction for suppressing fluctuation of outputs in each of the engine cylinders. The process of combustioning condition dependent fuel injection control will be hereafter disclosed with reference to FIGS. 6 to 8.

Figure 6:
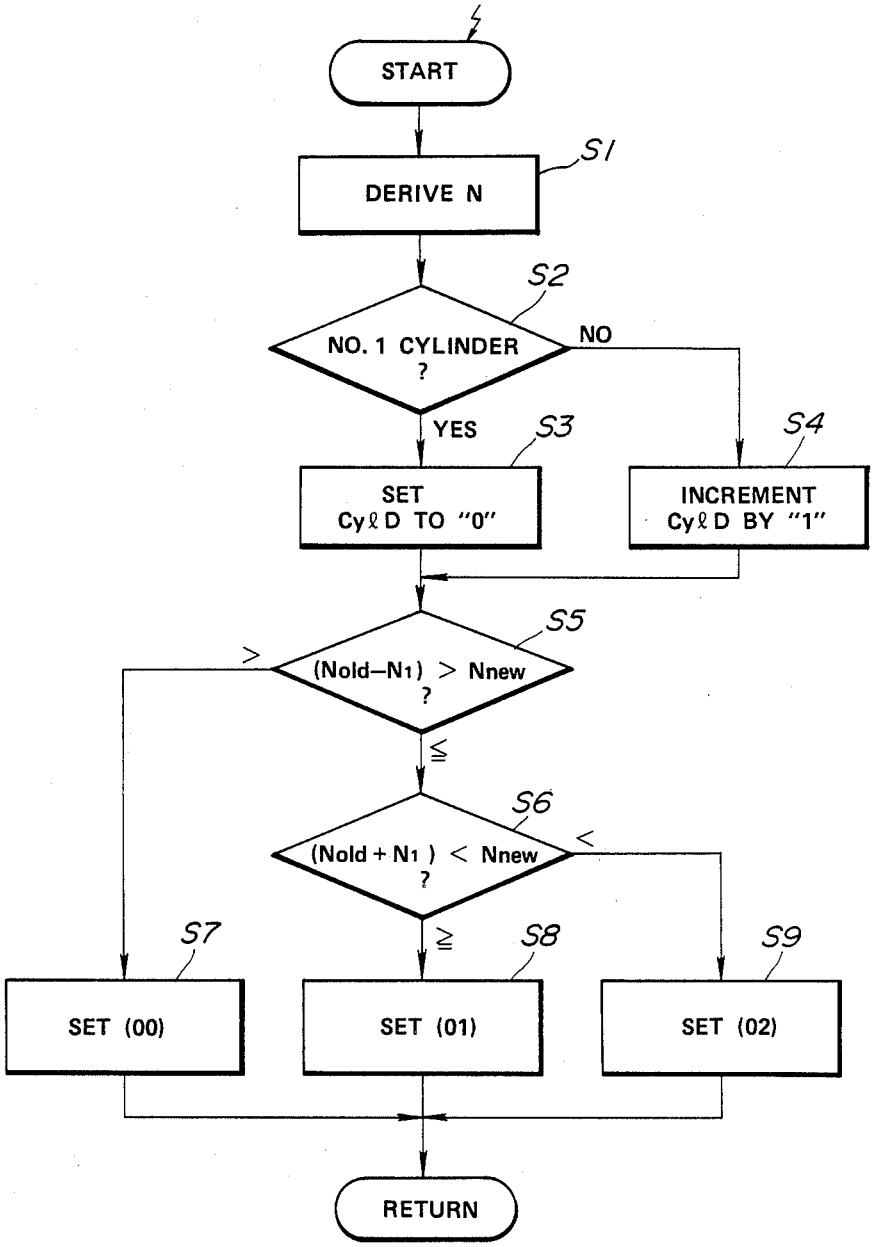
FIG. 6 is a flowchart of a combustioning condition discriminating routine to be executed by a control unit in the first embodiment of the fuel injection control system of FIG. 3.

FIG. 6 shows an engine speed fluctuation data deriving routine to be executed by the control unit of FIG. 3. The shown routine of FIG. 6 is designed to be triggered by the crank reference signal $\theta_{ref}$. Namely, the engine speed fluctuation data deriving routine is executed everytime the crank reference signal $\theta_{ref}$ occurs.

Immediately after starting execution, the engine speed derivation is performed at a step S1. The engine speed N is derived on the basis of the interval of the occurrence of the crank reference signals $\theta_{ref}$. The interval of the occurrences of the crank reference signal is measured by counting the clock signal generated by the clock signal generator 140. The counted value may be reset immediately after reading out the counted value at the step S1. A reciprocal of the counted value of the clock signal may serve as the engine speed indicative data N. Derived engine speed indicative data N is temporarily stored in preselected address blocks 162, 164, 166 and 168. Each of address blocks 162, 164, 166 and 168 of RAM 134 are designed for storing the engine speed data $N_{old}$ which is derived one cycle ahead of execution of the routine of FIG. 6, and the engine speed data $N_{new}$ which is derived in the current execution cycle of the routine of FIG. 3. The memory address 162 thus serves as a sort of shift-register for shifting the engine speed data $N_{new}$ to be the older engine speed data $N_{old}$ everytime the new engine speed data is derived.

In the alternative, it would be possible to derive the engine speed by counting the crank position signal $\theta_{pos}$. In this case, an engine speed counter may be provided in the input interface in a well known manner. In this case, the engine speed indicative data N may be simply read out from the engine speed counter in the input interface.

After deriving the engine speed indicative data N, discrimination of the engine cylinders is performed at a step S2. The pulse width of the crank reference signal $\theta_{ref}$ is used. Namely, as seen from FIGS. 4, 5(A) and 5(B) and relevant discussion, the pulse width of the crank reference signal $\theta_{ref}$ representative of 70° BTDC of No. 1 cylinder is longer than that of others. Therefore, by comparing the pulse width of the crank reference signal $\theta_{ref}$ with a reference value which corresponds to the pulse width of the crank reference signal of the No. 1 cylinder, the No. 1 cylinder reaching 70° BTDC can be detected when the crank reference signal pulse width is equal to the reference value. When the 70° BTDC of the No. 1 cylinder is detected at the step S2, the process goes to a step S3, at which a cylinder number data cylD is reset to 'zero (0)'. On the other hand, when the pulse width of the crank reference signal is smaller than the reference value, the process goes to a step S4. At the step, the cylinder indicative data cylD is incremented by one (1). Since the order of combustion in the cylinders is No.1-No.3-No.4-No.2, the cylinder number '1', '2' and '3' respectively represents No. 3, No. 4 and No. 2 cylinders.

After the process in the step S3 or S4, the engine speed data $N_{old}$ and $N_{new}$ are read out. A reference value $(N_{old}-N_1)$ is calculated by subtracting the given engine speed difference criterion $N_1$ from the older engine speed data $N_{old}$. The calculated value $(N_{old}-N_1)$ is compared with the new engine speed data $N_{new}$, at a step S5. When the new engine speed data $N_{new}$ is smaller than the calculated value $(N_{old}-N_1)$, judgement is made that the engine speed drop has dropped beyond the engine speed variation criterion $N_1$, which requires enrichment which tends to be caused by too lean a mixture or by mis-firing. Therefore, an enrichment demand indicative flag (00) is set in one of memory blocks 164, 166, 168 and 170 which are respectively designed for storing combustioning condition dependent fuel amount correction data $\Delta N$, at a step S7. In order to set the flue amount correction data $\Delta N$ in the memory block corresponding to the combustioning cylinder, CPU 130 outputs an address signal identifying one of the memory blocks 164, 166, 168 and 170. Namely, when the enrichment demand indicative fuel amount correction flag (00) is to be set in response to the crank reference signal indicative of 70° BTDC of No. 1 cylinder, then the memory block 168 for storing the enrichment demand indicative fuel amount correction flag of No. 4 cylinder is identified.

On the other hand, when the new engine speed data $N_{new}$ is greater than or equal to the calculated value $(N_{old}-N_1)$, the process goes to a step S6, in which another reference value $(N_{old}+N_1)$ is calculated and compared with the new engine speed data $N_{new}$. When the new engine speed data $N_{new}$ is greater than the reference value $(N_{old}+N_1)$, judgement is made that the engine speed increases at a substantial level exceeding the engine speed variation criterion $N_1$, which means combustion in the corresponding engine cylinder is excessive. Then, the process goes to a step S9 to set the combustioning condition dependent fuel amount correction flag (02) to reduce the fuel injection amount. This flag (02) will be hereafter referred to as the lean fuel demand indicative flag. The lean fuel demand indicative flag (02) will be set at one of the memory blocks 164, 166, 168 and 170 corresponding to the engine cylinder combustioning.

On the other hand, when the new engine speed data $N_{new}$ is smaller than or equal to the reference value $(N_{old}+N_1)$, which means engine speed variation during a period between combustion timings is within a predetermined range defined by the engine speed variation criterion $\pm N_1$, the process goes to a step S8. In the step S8, a normal engine condition indicative flag (01) is set in the corresponding memory block 164, 166, 168 and 170.

Figure 7:
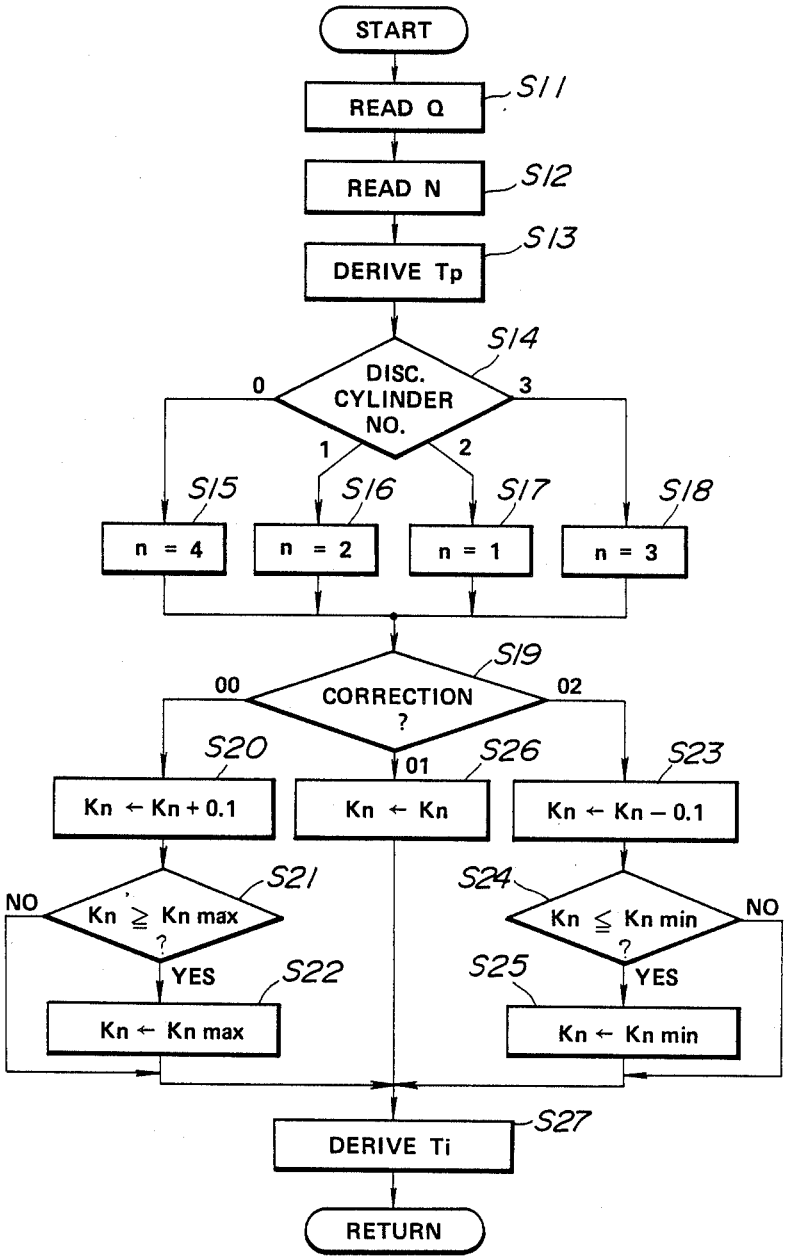
FIG. 7 is a flowchart of a fuel injection amount derivation routine to be executed by a control unit in the first embodiment of the fuel injection control system of FIG. 3.

FIG. 7 shows a process for deriving the corrected fuel injection amount in conjunction with taking the combustioning condition dependent engine speed correction value. The shown routine of FIG. 7 is triggered at a given timing, such as every 10 ms. Immediately after starting execution of the shown routine, the air flow rate indicative signal value Q is read out at a step S11 and subsequently the engine speed data N is read out at a step S12. In practice, the engine speed data N is read from the address block 162 of RAM. Based on the air flow rate indicative signal value Q and the engine speed data N read out at the steps S11 and S12, the basic fuel injection amount Tp is calculated according to the foregoing and known equation $(Tp=K\times Q/N)$, at a step S13.

After the step S13, the cylinder number to determine the fuel injection amount is discriminated at a step S14. In practice, discrimination of the cylinder number is performed by checking the cylinder number indicative data cylD. Namely, when the cylinder number indicative data cylD is zero (0), it represents that the No. 1 cylinder approaches its TDC in compression stroke and thus the No. 4 cylinder approaches TDC at which the induction stroke starts. Therefore, the process goes to a step S15 to set the result of discrimination data n to 4 which indicates the cylinder number being No. 4 to determine the fuel injection amount. Similarly, when the cylinder number indicative data cylD is one (1), it represents that the No. 3 cylinder approaches its TDC in compression stroke and thus the No. 2 cylinder approaches TDC at which the induction stroke starts. Therefore, the process goes to a step S16 to set the result of discrimination data n to 2 indicative of the cylinder number being No. 2 to determine the fuel injection amount. When the cylinder number indicative data cyD is two (2), it represents that No. 4 cylinder approaches its TDC in compression stroke and thus the No. 1 cylinder approaches TDC at which the induction stroke starts. Therefore, the process goes to a step S17 to set the result of discrimination data n to 1 indicative of the cylinder number being No. 1 to determine the fuel injection amount. Furthermore, when the cylinder number indicative data cylD is three (3), it represents that the No. 2 cylinder approaches its TDC in compression stroke and thus the No. 3 cylinder approaches TDC at which the induction stroke starts. Therefore, the process goes to a step S18 to set the result of discrimination data n to 3 indicative of the cylinder number being No. 3 to determine the fuel injection amount.

The discriminated data n is read at a step S19 in order to identify the cylinder number about which the fuel injection amount is to be derived. The read discriminated data n is also used as identification of the memory addresses 164, 166, 168 and 170. Therefore, CPU 130 outputs the address signal identifying the corresponding memory address. At the step S19, one of the memory blocks 164, 166, 168 and 170 is accessed to read out the fuel amount correction flag set in the corresponding memory block. The read out fuel amount correction flag is checked at the step S19. If the read flag is the enrichment demand indicative flag (00), then the process goes to a step S20. In the step S20, a combustioning condition dependent fuel injection amount correction value Kn is determined by adding 0.1 to the preceding value Kn which is obtained with respect to the corresponding engine cylinder in the immediately preceding calculation. After deriving the new fuel injection amount correction value Kn at the step S20, the derived amount is compared with a predetermined maximum correction value $Kn_{max}$, at a step S21. If the derived correction value Kn is greater than or equal to the predetermined maximum correction value $Kn_{max}$, the process goes to a step S22 to modify the derived correction value Kn to the maximum value $Kn_{max}$. Thereafter, arithmetic operation is performed to derive the corrected fuel injection amount Ti according to the following equation:

$$Ti = Tp \times COEF \times \alpha(1+Kn) + Ts$$

at a step S27. The derived fuel injection amount Ti is set in one of memory blocks 172, 174, 176 and 178 in RAM.

On the other hand, when the correction value derived at the step S20 is smaller than the predetermined maximum correction value $Kn_{max}$ as checked at the step S21, the process goes to the step S27 jumping the step S22.

When the fuel injection amount correction flag as checked at the step S19 is the normal engine condition indicative flag (01), the precedingly obtained correction value Kn is set as is, at a step S26. After the step S26, the process goes to the step S27 to derive the corrected fuel injection amount Ti.

When the fuel injection amount correction flag as checked at the step S19 is the lean demand indicative flag (02), the process goes to a step S23. In the step S23, the preceding correction value Kn set in the former calculation cycle is modified by subtracting 0.1. The derived correction value Kn is compared with a predetermined minimum correction value $Kn_{min}$, at a step S24. If the correction value Kn is smaller than or equal to the minimum correction value $Kn_{min}$ as checked at the step S24, the process goes to a step S25 to modify the correction value Kn to the minimum correction value $Kn_{min}$. After setting the correction value at the minimum correction value $Kn_{min}$, the process goes to the step S27 to derive the corrected fuel injection amount Ti. When the correction value derived at the step S24 is greater than the minimum correction value $Kn_{min}$, the process directly goes to the step S27 jumping the step S25.

The derived amount of the fuel is injected through the fuel injection valves **10*a*, 10*b*, 10*c* and 10*d* at a controlled timing which is determined depending upon the engine driving condition. As is well known, the fuel injection timing will be determined in relation to an engine operation parameter, such as engine speed and engine load. In the multi-point injection, the fuel injection timing and derivation thereof has been disclosed in the aforementioned U.S. Pat. No. 4,562,812. The disclosure of this United States Patent is herein incorporated by reference for the sake of disclosure. Therefore, although not fully explained here, the control unit 100 may perform another control operation for determining the fuel injection timing for each engine cylinder independently of each other. Based on the result of control operation, the control unit 100** may output a fuel injection control signal at the determined timing for initiating fuel injection.

Figure 8:
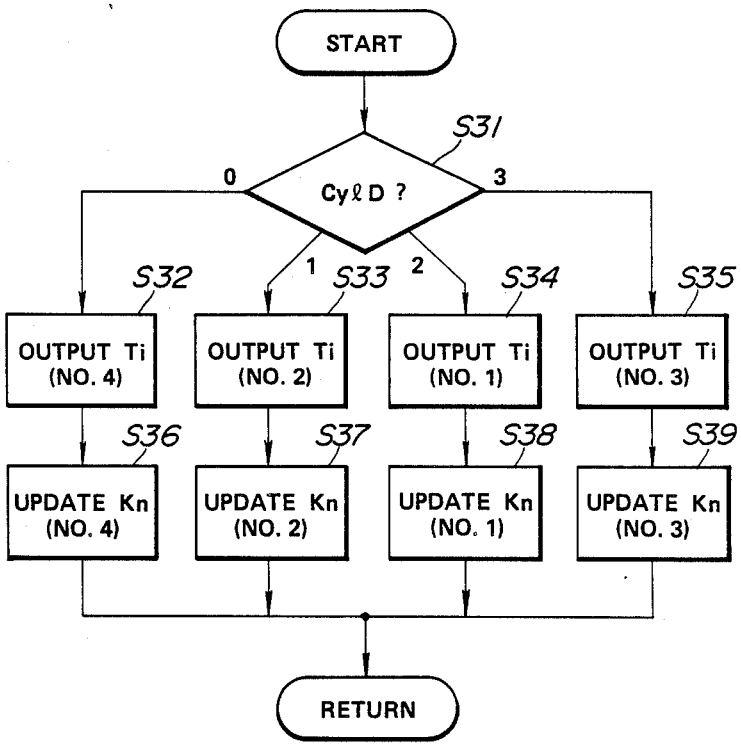
FIG. 8 is a flowchart of a fuel injection pulse output control routine to be executed by a control unit in the first embodiment of the fuel injection control system of FIG. 3.

FIG. 8 shows a process for controlling fuel injection in each fuel injection valve **10*a*, 10*b*, 10*c* and 10*d*. This routine is triggered by the fuel injection timing signal to perform outputting of the fuel injection signal indicative of the fuel injection amount derived in the execution of the routine of FIG. 7. Immediately after starting execution, discrimination of the engine cylinder for which the fuel injection is to be performed takes place at a step S31. Similarly to the step S14 of the aforementioned routine of FIG. 7, the cylinder number indicative data cylD will be used for discriminating the engine cylinder to perform fuel injection. Namely, when the cylinder number indicative data cylD is 0, discrimination is made that the fuel injection is to be made for the No. 4 cylinder. Therefore, at a step S32, the fuel injection amount Ti stored in the memory block 178 is read out and output to the driver circuit 160. The driver circuit 160 is responsive to the fuel injection signal to activate the fuel injection valve 10*d*** to open for the period corresponding to the pulse width of the fuel injection signal.

Similarly, when the cylinder number indicative data cylD is 1, the fuel injection amount Ti stored in the memory block 174 is read out and output as the fuel injection signal having a pulse width corresponding to the fuel injection amount, at a step S33. Thus, the driver circuit 156 drives the fuel injection valve for the period corresponding to the pulse width of the fuel injection valve. When the cylinder number indicative data cylD is 2, the fuel injection amount Ti stored in the memory block 172 is read out and output as the fuel injection signal having a pulse width corresponding to the fuel injection amount, at a step S34. Thus, the driver circuit 154 drives the fuel injection valve for the period corresponding to the pulse width of the fuel injection valve. On the other hand, when the cylinder number indicative data cylD is 3, the fuel injection amount Ti stored in the memory block 176 is read out and output as the fuel injection signal having a pulse width corresponding to the fuel injection amount, at a step S35. Thus, the driver circuit 158 drives the fuel injection valve for the period corresponding to the pulse width of the fuel injection valve.

After one of the steps S32 to S35, the process goes to associated one of steps S36, S37, S38 and S39 for updating the correction value data as derived at the step S20, S22, S23 or S25 as old correction value data to be used in the next execution cycle for determining the fuel injection amount Ti.

Figure 9:
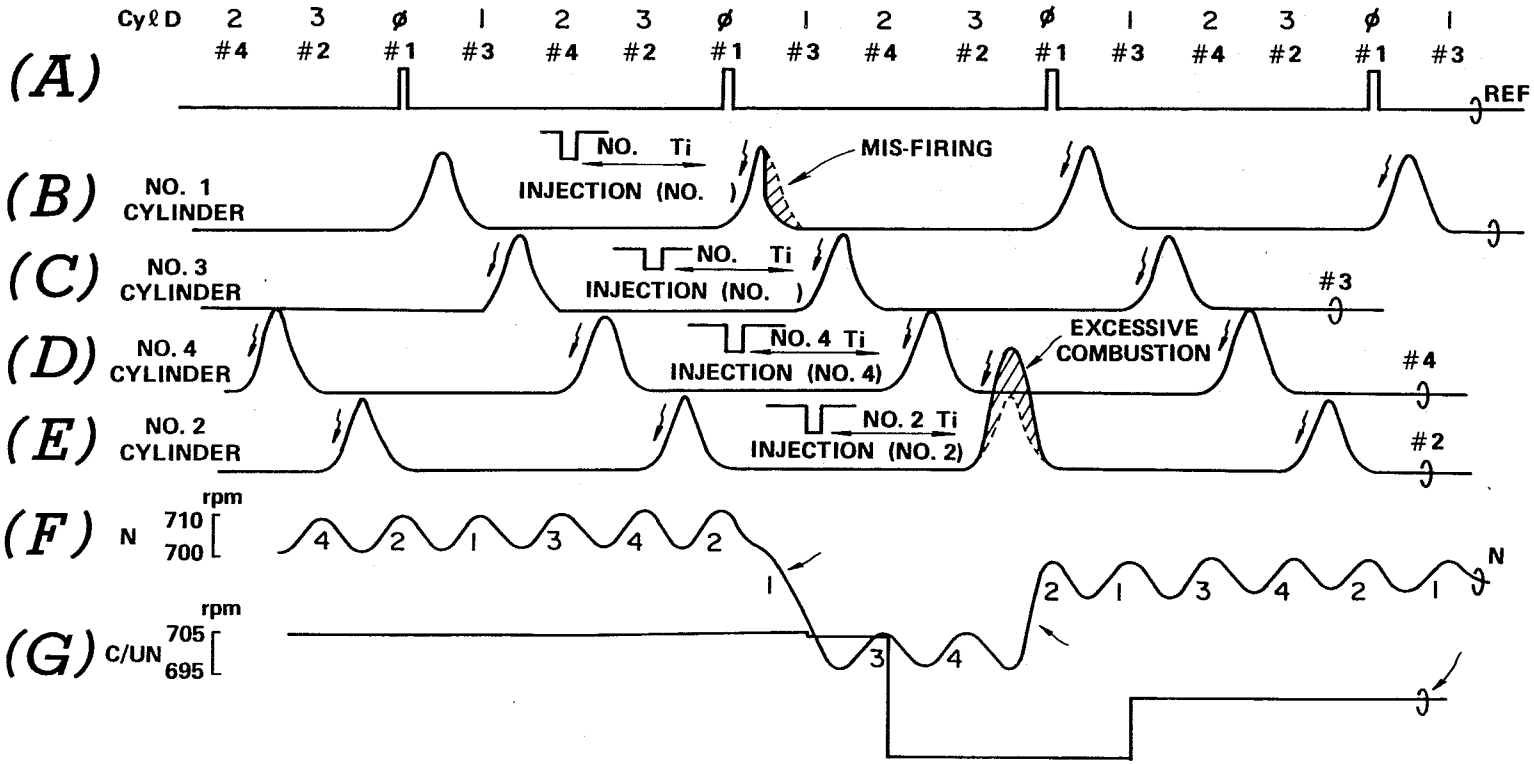
FIGS. 9, A–G are a timing chart showing combustioning conditions in each individual engine cylinder.

The practical operation of the aforementioned first embodiment of the fuel injection control system will be discussed with reference to FIG. 9. In FIG. 9, line A shows timing of the crank reference signal $\theta_{ref}$ indicative of 70° BTDC of the No. 1 cylinder. Lines B, C, D and E indicate variation of the internal pressure in each of No. 1, No. 2, No. 3 and No. 4 cylinders. As seen from the line B, if mis-firing occurs in the engine cylinder, the average pressure in the engine cylinder, i.e., No. 1 cylinder, is lowered. On the other hand, as seen from line E, when excessive combustion occurs, the average pressure in the engine cylinder becomes excessively high.

When mis-firing occurs in one of the engine cylinders, the engine speed drops as illustrated by a line F in FIG. 9. The control unit 100 is detective of this engine speed drop to perform fluctuation suppressive fuel injection amount correction to increase the fuel injection amount for the next occurrence of fuel injection. Namely, in the shown embodiment, drop of the engine speed is determined in execution of the routine of FIG. 6 in response to the crank reference signal of the No. 3 cylinder. As will be appreciated, since the No. 2 cylinder is approaching the induction stroke TDC, the fuel injection amount for the No. 2 cylinder is modified in the fluctuation suppressive fuel injection correction to increase the fuel injection amount. As a result, the air/fuel mixture to be supplied into the No. 2 cylinder during its induction stroke becomes richer. As a result, as shown by line E, stronger combustion occurs in the No. 2 cylinder to compensate for drop of the engine speed due to mis-firing in the No. 1 cylinder.

Therefore, as will be appreciated herefrom, the engine speed fluctuation due to the difference of the combustioning conditions in respective individual cylinders can be compensated by correcting the fuel injection amount depending upon the engine driving condition. This provides better driveability for the engine and better engine performance.

Figure 10:
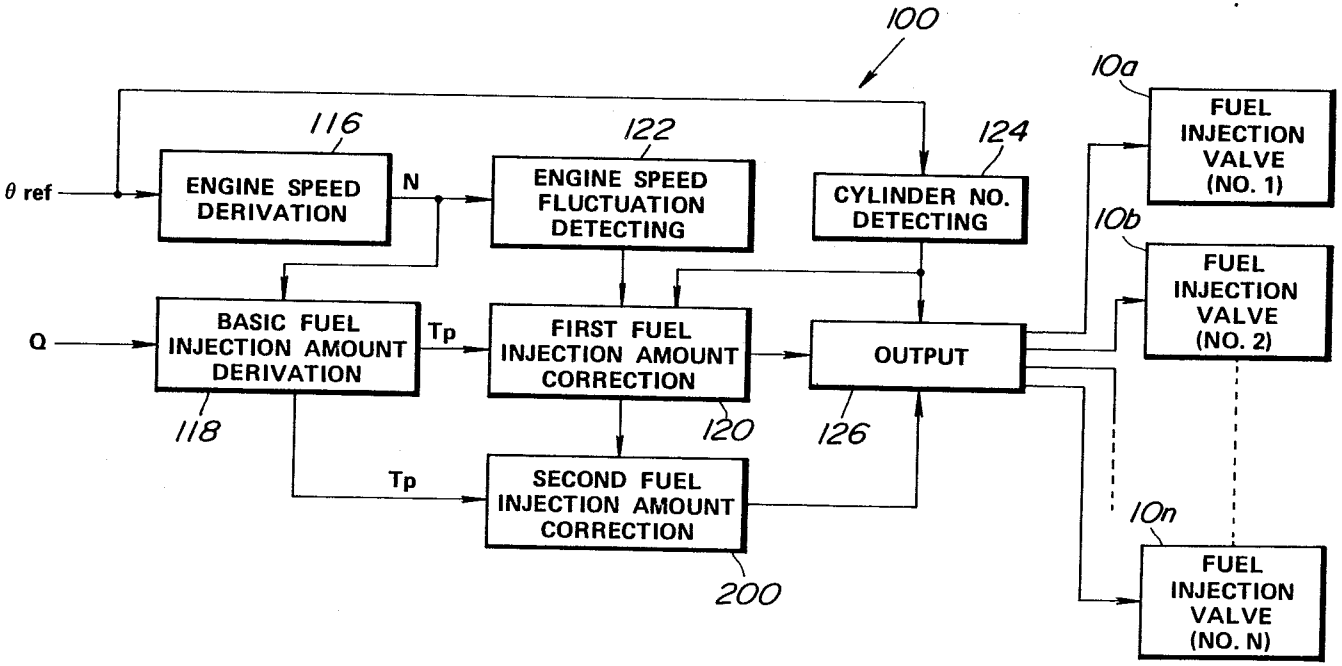
FIG. 10 is a functional and schematic block diagram of the second embodiment of a fuel injection control system according to the invention.

FIG. 10 shows the second embodiment of the fuel injection control system according to the invention. In the following disclosure, the elements which are provided in common construction and for common function to the foregoing first embodiment set forth above will be represented b the same reference numerals. Since such common elements are already discussed in the discussion about the first embodiment, further discussion will be omitted to avoid confusion which tends to be caused by redundant discussions.

As seen from FIG. 10, the second embodiment of the fuel injection control system includes a second fuel injection amount correcting stage 200 in the control unit 100. This second fuel injection amount correcting stage 200 is designed for adjusting the fuel injection amount for the engine cylinders other than the engine cylinder for which the combustioning condition dependent fuel injection amount correction is performed. In the following disclosure, the engine cylinder, for which the combustioning condition dependent fuel injection amount correction value is derived by the fuel injection amount correcting stage 120 will be referred to as the 'specific cylinder'. The second fuel injection amount correcting stage 200 is cooperative with the fuel injection amount correcting stage 120 so as to receive the correction value derived in the latter for the specific cylinder and to derive the correction value for other cylinders based on the correction value for the specific cylinder. In practical operation, the second fuel injection amount correcting stage 200 derives the correction value for the cylinders other than the specific cylinder to distribute the correction value derived for the specific cylinder to other cylinders in even rate. The correction value derived for the other cylinders will serve to modify the fuel injection amount in a direction opposite to that for the specific cylinder. For instance, when the correction value for increasing fuel injection amount is derived for the specific cylinder, the correction value for other cylinders is derived for reducing the fuel injection amount.

Figure 11:
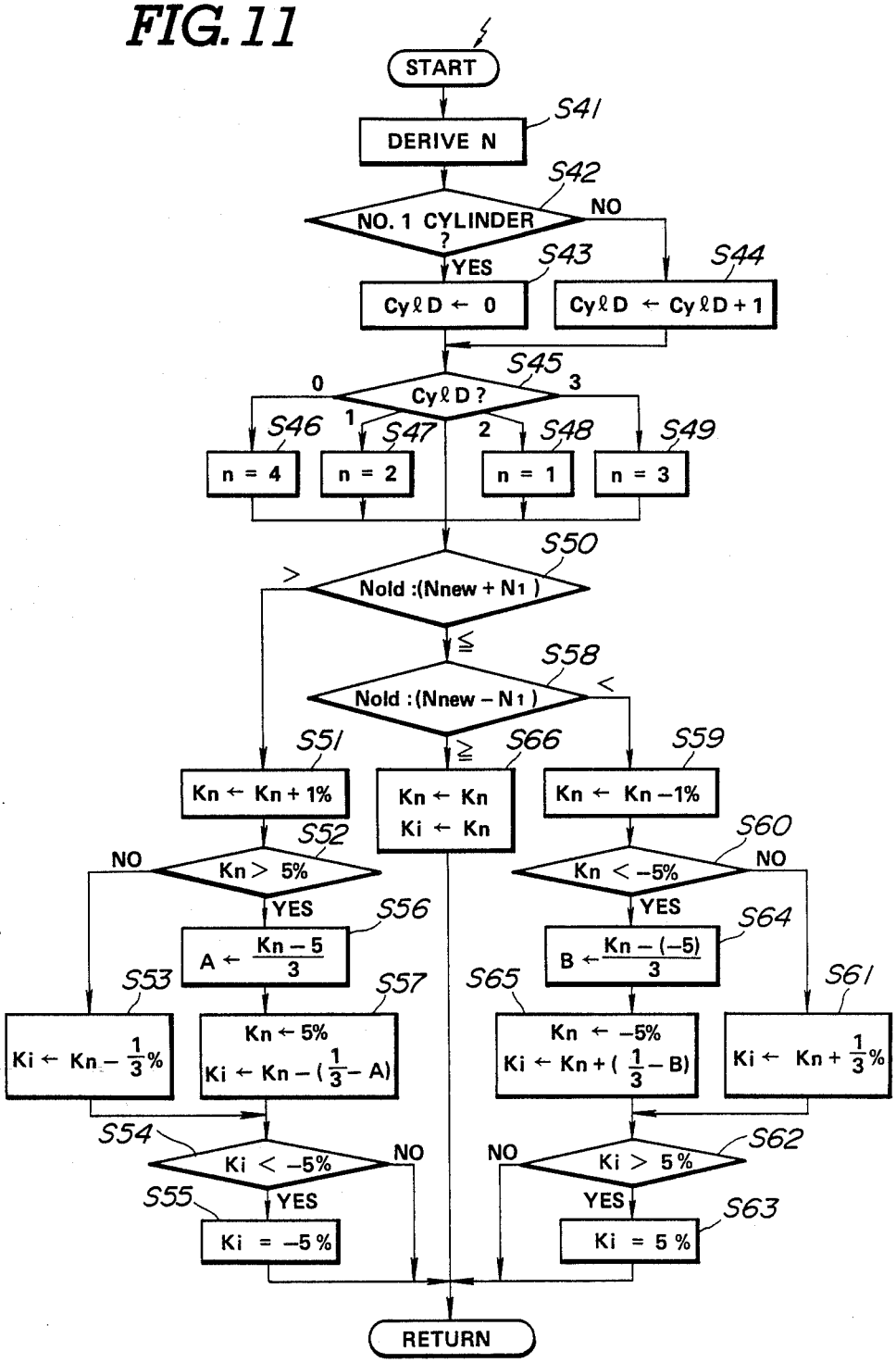
FIG. 11 is a flowchart of a combustioning condition discriminating routine to be executed by a control unit in the second embodiment of the fuel injection control system of FIG. 10.

FIG. 11 shows a process for determining the fuel injection amount for respective engine cylinders according to the second embodiment of the invention. The flowchart shown in FIG. 11 is directed for controlling a fuel injection amount for a 4-cylinder, 4-cycle internal combustion engine.

Immediately after starting execution, the engine speed derivation is performed at a step S41. The engine speed N is derived on the basis of the interval of the occurrence of the crank reference signals $\theta_{ref}$. The interval of the occurrences of the crank reference signal is measured by counting the clock signal generated by the clock signal generator 140 of FIG. 3. The counted value may be reset immediately after reading out the counted value at the step S41. A reciprocal of the counted value of the clock signal may serve as the engine speed indicative data N. Derived engine speed indicative data N is temporarily stored in preselected address blocks 162, 164, 166 and 168.

After deriving the engine speed indicative data N, discrimination of the engine cylinders is performed at a step S42. In practice, the pulse width of the crank reference signal $\theta_{ref}$ is compared with a reference value which corresponds to the pulse width of the crank reference signal of the No. 1 cylinder, the No. 1 cylinder reaching 70° BTDC can be detected when the crank reference signal pulse width equal to the reference value is detected. When the 70° BTDC of the No. 1 cylinder is detected at the step S42, the process goes to a step S43, at which a cylinder number data cylD is reset to 'zero (0)'. On the other hand, when the pulse width of the crank reference signal is smaller than the reference value, the process goes to a step S44. At the step S44, the cylinder indicative data cylD is incremented by one (1). Since the order of combustion in the cylinders is No.1-No.3-No.4-No.2, the cylinder numbers '1', '2' and '3' respectively represent the No. 3, No. 4 and No. 2 cylinders.

After the step S43 or S44, the cylinder number to determine the fuel injection amount is discriminated at a step S45. In practice, discrimination of the cylinder number is performed by checking the cylinder number indicative data cylD. Namely, when the cylinder number indicative data cylD is zero (0), it represents that the No. 1 cylinder approaches its TDC in compression stroke and thus the No. 4 cylinder approaches TDC at which the induction stroke starts. Therefore, the process goes to a step S46 to set the result of discrimination data n to 4 which indicates the cylinder number being No. 4 to determine the fuel injection amount. Similarly, when the cylinder number indicative data cylD is one (1), it represents that the No. 3 cylinder approaches its TDC in compression stroke and thus the No. 2 cylinder approaches TDC at which the induction stroke starts. Therefore, the process goes to a step S47 to set the result of discrimination data n to 2 indicative of the cylinder number being No. 2 to determine the fuel injection amount. When the cylinder number indicative data cylD is two (2), it represents that the No. 4 cylinder approaches its TDC in compression stroke and thus the No. 1 cylinder approaches TDC at which the induction stroke starts. Therefore, the process goes to a step S48 to set the result of discrimination data n to 1 indicative of the cylinder number being No. 1 to determine the fuel injection amount. Furthermore, when the cylinder number indicative data cylD is three (3), it represents that the No. 2 cylinder approaches its TDC in compression stroke and thus the No. 3 cylinder approaches TDC at which the induction stroke starts. Therefore, the process goes to a step S49 to set the result of discrimination data n to 3 indicative of the cylinder number being No. 3 to determine the fuel injection amount.

After one of the steps S46 to S49, the engine speed data $N_{old}$ and $N_{new}$ are read out. A reference value ($N_{new}+N_1$) is calculated by adding the given engine speed difference criterion $N_1$ from the younger engine speed data $N_{old}$. The calculated value ($N_{new}+N_1$) is compared with the older engine speed data $N_{old}$, at a step S50.

When the older engine speed data $N_{old}$ is greater than the calculated value ($N_{new}+N_1$), judgement is made that the engine speed drops beyond the engine speed variation criterion $N_1$, which requires enrichment which tends to be caused by too lean a mixture or by mis-firing, at a step S51. Based on this judgement, a combustioning condition dependent correction value Kn for the specific cylinder is derived by adding 1%, at the step S51. After derivation of the correction value Kn for the specific cylinder at the step S51, the derived value Kn is compared with a predetermined maximum value, e.g., 5% at a step S52. If the correction value Kn is smaller than or equal to 5%, the process goes to a step S53, in which correction value Ki for other cylinders is derived. In the process in the step S53, the correction values Kn of respective other cylinders are read out and modified as the correction value Ki by subtracting $\frac{1}{3}$%.

It should be appreciated since the shown embodiment is directed to the 4-cylinder engine, the value corresponding to the correction value, i.e., 1% of the specific cylinder, is distributed for three other cylinders. Therefore, the correction value to be subtracted from the respective correction value Kn of three other cylinders becomes $\frac{1}{3}$%. However, in the case of an engine having a different number of cylinders, the distribution ratio of the correction value will become different.

After the step S53, the derived correction value Ki of other cylinders is compared with a predetermined minimum value, e.g., −5%, at a step S54. If the correction value Ki is smaller than the minimum value, the correction value Ki is modified to be the predetermined minimum value, i.e., −5%, at a step S55.

On the other hand, when the correction value Kn for the specific cylinder is greater than the maximum value (5%) as checked at the step S51, a value A with which the correction value Kn of other cylinders will be modified to derive the correction value Ki is produced at a step S56. As seen, in the step S56, A is obtained by (Kn−5)/3, in which Kn is the correction value of the specific cylinder. After derivation of the value A, the process goes to a step S57, in which the correction value Kn for the specific cylinder is modified and set as the maximum value i.e. 5%. At the step S57, the correction value Ki for other cylinders is also determined by the following equation:

$$Ki=Kn-(\tfrac{1}{3}-A)$$

where Kn represents the already determined correction value of other cylinders.

After the process at the step S57, the process goes to the step S54.

When the derived correction value Ki of other cylinders as checked at the step S54 is greater than or equal to the minimum value, e.g., −5%, the step S55 is jumped. Therefore, the derived correction value Ki will be set as correction values of other cylinders.

When the reference value ($N_{new}+N1$) is greater than or equal to the older engine speed data $N_{old}$ as checked at the step S50, another reference value ($N_{new}-N_1$) is determined at a step S58. At the step S58, the derived reference value ($N_{new}-N_1$) is compared with the older engine speed data $N_{old}$. When the older engine speed data $N_{old}$ is smaller than the calculated value ($N_{new}+N_1$), judgement is made that the engine speed is increased beyond the engine speed variation criterion $N_1$, which requires reduction of the fuel injection amount, at a step S59. Based on this judgement, a combustioning condition dependent correction value Kn for the specific cylinder is derived by subtracting 1%, at the step S59. After derivation of the correction value Kn for the specific cylinder at the step S59, the derived value Kn is compared with a predetermined minimum value, e.g. −5%, at a step S60. If the correction value Kn is greater than or equal to −5%, the process goes to a step S61, in which a correction value Ki for other cylinders is derived. In the process in the step S61, the correction values Kn of respective other cylinders are read out and modified as the correction value Ki by adding $\frac{1}{3}$%.

After the step S61, the derived correction value Ki of other cylinders is compared with a predetermined maximum value, e.g., 5%, at a step S62. If the correction value Ki is greater than the minimum value, the correction value Ki is modified to be the predetermined maximum value, i.e., 5%, at a step S62.

On the other hand, when the correction value Kn for the specific cylinder is smaller than the minimum value (−5%) as checked at the step S60 a value B with which the correction value Kn of the other cylinders will be modified to derive the correction value Ki is produced at a step S64. As seen, in the step S57, the value B is obtained by {Kn−(−5)}/3, in which Kn is the correction value of the specific cylinder. After derivation of the value B, the process goes to a step S65, in which the correction value Kn for the specific cylinder is modified and set as the minimum value, i.e., −5%. At the step S65, the correction value Ki for other cylinders is also determined by the following equation:

$$Ki=Kn+(\tfrac{1}{3}-B)$$

where Kn represents the already determined correction value of other cylinders.

After the process at the step S65, the process goes to the step S62.

When the derived correction value Ki of other cylinders as checked at the step S62 is smaller than or equal to the maximum value, e.g., 5%, the step S63 is jumped. Therefore, the derived correction value Ki will be set as the correction values of other cylinders.

On the other hand, when the reference value ($N_{new}-N_1$) is smaller than or equal to the older engine speed data $N_{old}$ as checked at the step S58, the process goes to a step S66 to set the older correction values Kn of respective cylinders as they are.

Figure 12:
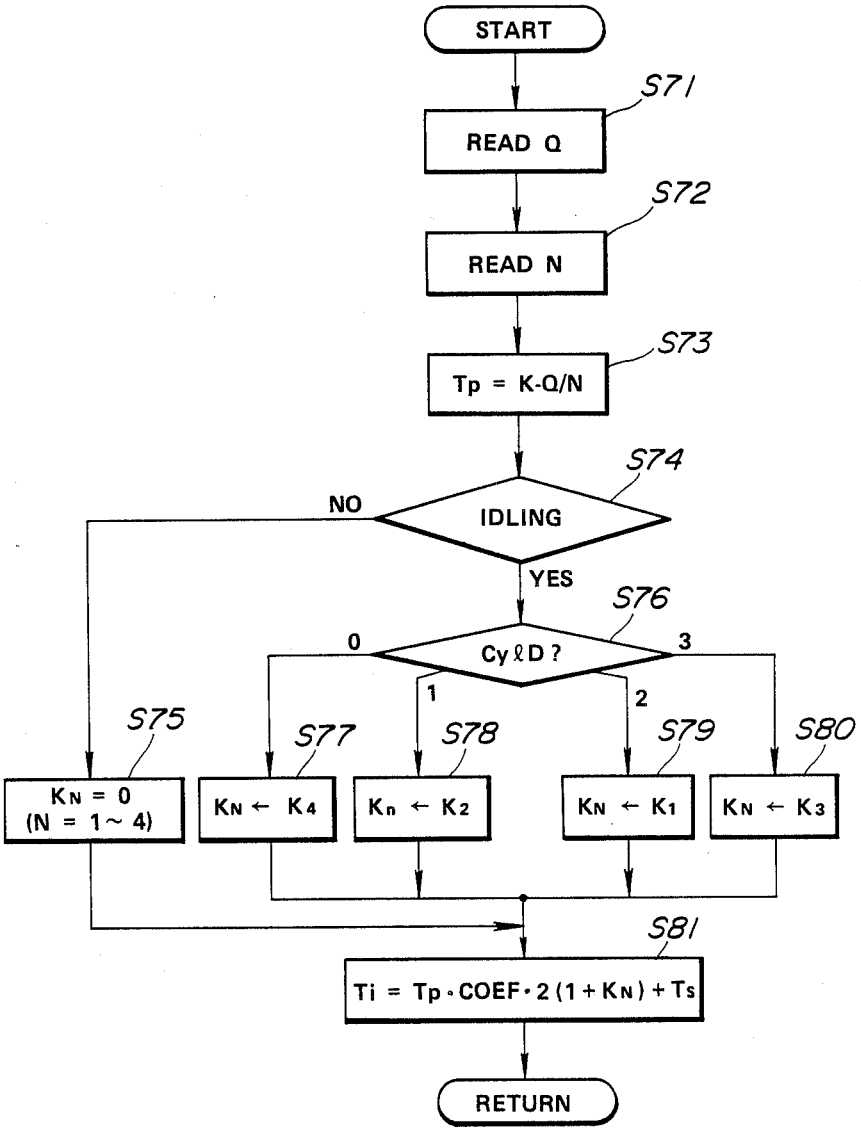
FIG. 12 is a flowchart of a fuel injection amount derivation routine to be executed by a control unit in the second embodiment of the fuel injection control system of FIG. 10.

Based on the correction values derived as set forth above, a fuel injection amount is determined for respective cylinders in synchronism with engine revolution according to the process shown in FIG. 12.

Immediately after starting execution of the shown routine, the air flow rate indicative signal value Q is read out at a step S71 and subsequently the engine speed data N is read out at a step S72. In practice, the engine speed data N is read from the address block 162 of RAM. Based on the air flow rate indicative signal value Q and the engine speed data N read out at the steps S71 and S72, the basic fuel injection amount Tp is calculated according to the foregoing and known equation ($Tp=K\times Q/N$), at a step S73.

After the step S73, an engine driving condition is checked at a step S74, i.e., whether the engine is in an idling condition or not. Checking of the engine idling condition may be performed by checking the throttle valve angular position on the basis of the throttle angle indicative signal of the throttle angle sensor in the embodiment of FIG. 3. In the alternative, a known engine idling switch which may be turned ON while the engine is in the idling condition of the engine, can be employed for detecting the engine idling condition. When the engine is not in the idling condition, the process goes to a step S75, in which the fuel injection amount correction values Kn of respective cylinders are set to zero (0).

On the other hand, when the engine idling condition is detected at the step S74, the cylinder number to determine the fuel injection amount is discriminated at a step S76. In practice, discrimination of the cylinder number is performed by checking the cylinder number indicative data cylD. Namely, when the cylinder number indicative data cylD is zero (0), it represents that the No. 1 cylinder approaches its TDC in compression stroke and thus the No. 4 cylinder approaches TDC at which the induction stroke starts. Therefore, the process goes to a step S77 to set the result of discrimination data n to 4 which indicates the cylinder number being No. 4 to determine the fuel injection amount. Similarly, when the cylinder number indicative data cylD is one (1), it represents that No. 3 cylinder approaches its TDC in compression stroke and thus the No. 2 cylinder approaches TDC at which the induction stroke starts. Therefore, the process goes to a step S78 to set the result of discrimination data n to 2 indicative of the cylinder number being No. 2 to determine the fuel injection amount. When the cylinder number indicative data cylD is two (2), it represents that No. 4 cylinder approaches its TDC in compression stroke and thus the No. 1 cylinder approaches TDC at which the induction stroke starts. Therefore, the process goes to a step S79 to set the result of discrimination data n to 1 indicative of the cylinder number being No. 1 to determine the fuel injection amount. Furthermore, when the cylinder number indicative data cylD is three (3), it represents that the No. 2 cylinder approaches its TDC in compression stroke and thus the No. 3 cylinder approaches TDC at which the induction stroke starts. Therefore, the process goes to a step S80 to set the result of discrimination data n to 3 indicative of the cylinder number being No. 3 to determine the fuel injection amount.

The discriminated data n is read at a step S82 in order to identify the cylinder number about which the fuel injection amount is to be derived. The read discriminated data n is also used as identification of the memory addresses 164, 166, 168 and 170. It should be noted that, in the shown embodiment, the memory addresses 164, 166, 168 and 170 are designed to store the correction value Kn as an actual value instead of the correction demand indicative flag. Based on the read discriminated data n, CPU 130 outputs the address signal identifying the corresponding memory address. At the step S81, one of the memory blocks 164, 166, 168 and 170 is accessed to read out the fuel amount correction value Kn set in the corresponding memory block. Also at the step S81, arithmetic operation is performed to derive the corrected fuel injection amount Ti according to the following equation:

$$Ti=Tp\times COEF\times\alpha(1+Kn)+Ts$$

at a step S81. The derived fuel injection amount Ti is set in one of memory blocks 172, 174, 176 and 178 in RAM.

Based on the derived fuel injection amount Ti, the fuel injection is performed by executing the fuel injection control routine which is identical to that discussed with respect FIG. 8.

Figure 13:
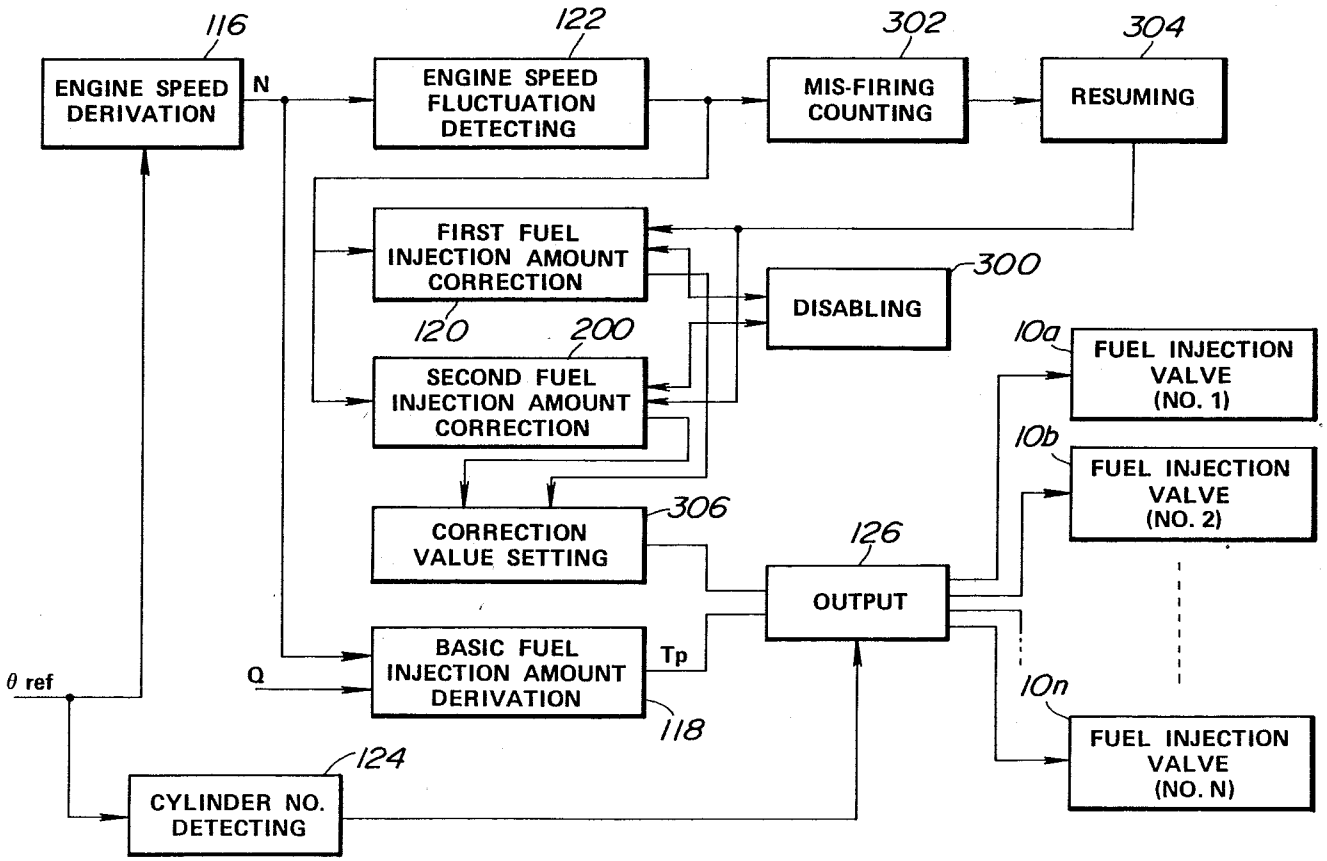
FIG. 13 is a functional and schematic block diagram of the third embodiment of a fuel injection control system according to the invention.

FIG. 13 shows the third embodiment of the fuel injection control system according to the invention. Similarly to the foregoing second embodiment, the common elements to the first and/or second embodiment will be represented by the same reference numerals for avoiding redundant recitation and confusion in understanding the invention.

As shown in FIG. 13, the shown third embodiment of the fuel injection control system includes a disabling stage 300 for disabling combustioning condition dependent fuel injection amount correction, in the control unit 100. The disabling stage 300 is associated with the aforementioned fuel amount correcting stage 120 and the second fuel amount correcting stage 200. The disabling stage 300 receives the correction values Kn for the specific cylinder and other cylinders in order to disable operation of the fuel amount correcting stage 120 and the second fuel amount correcting stage 200 so that combustioning condition dependent fuel amount correction value Kn may not be updated when one of the correction values Kn for the specific cylinder and other cylinders becomes out of a predetermined correction value range which is defined by predetermined maximum and minimum correction values. The control unit 100 also includes a mis-firing counter stage 302 which is active while the disabling stage 300 is active to disable the combustioning condition dependent fuel injection amount correction. The mis-firing counter stage 302 is designed for counting occurrence of a drop of engine speed of a magnitude exceeding a predetermined magnitude and thereby counting occurrence of mis-firing with respect to each of the individual engine cylinders. The mis-firing counter stage 302 is associated with a correction resuming stage 304 which is active for resuming operation of the fuel amount correction stage 120 and the second fuel amount correction stage 200.

Resumption of updating of the combustioning condition dependent fuel injection amount correction value Kn takes place when the mis-firing count with respect to one of the engine cylinders becomes in excess of a predetermined value.

The fuel amount correcting stage 120 and the second fuel amount correcting stage 200 are also connected to a correction amount setting stage 306. In the correcting amount setting stage 306, the correction values Kn are compared with a predetermined reference value or values which is smaller than the aforementioned maximum correction value and greater than the aforementioned minimum correction value. When the fuel amount correction value Kn of the respective specific cylinder and other cylinders is out of the range defined by the reference values but within the predetermined range defined by the maximum and minimum correction values, the correction values Kn are set at the reference value near the actually derived value.

Figure 14:
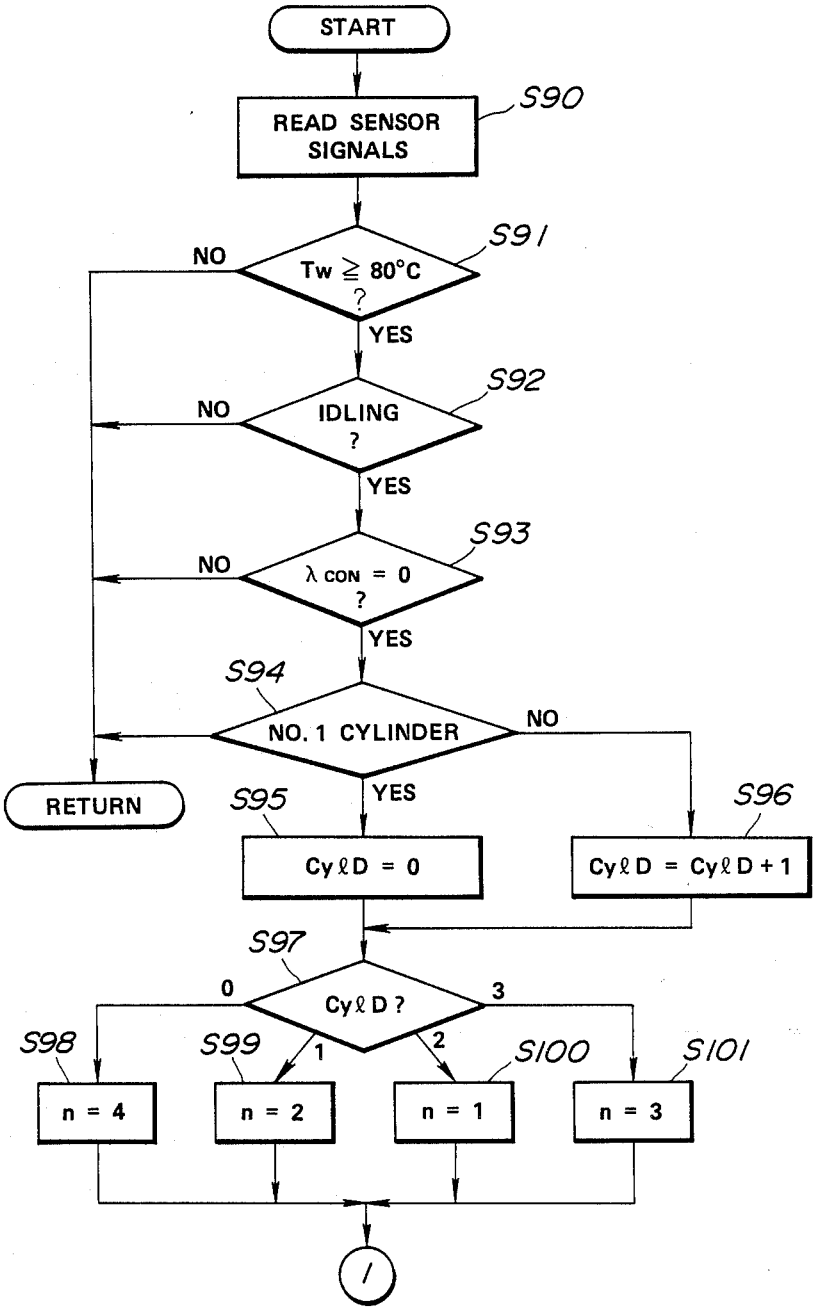
FIGS. 14(A) and 14(B) are flowcharts of a combustioning condition discriminating routine to be executed by a control unit in the third embodiment of the fuel injection control system of FIG. 13.
Figure 14:
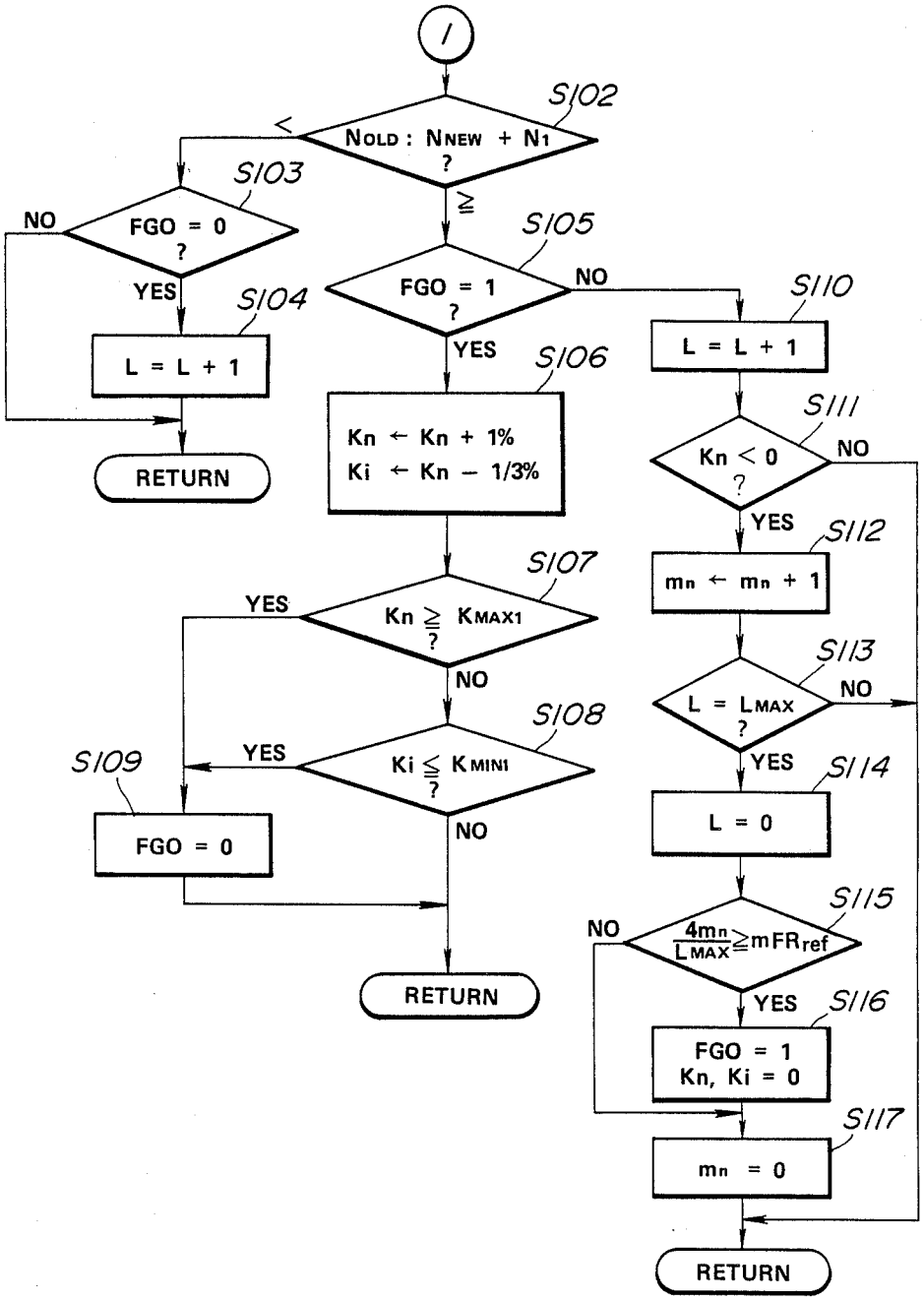
Figure 15:
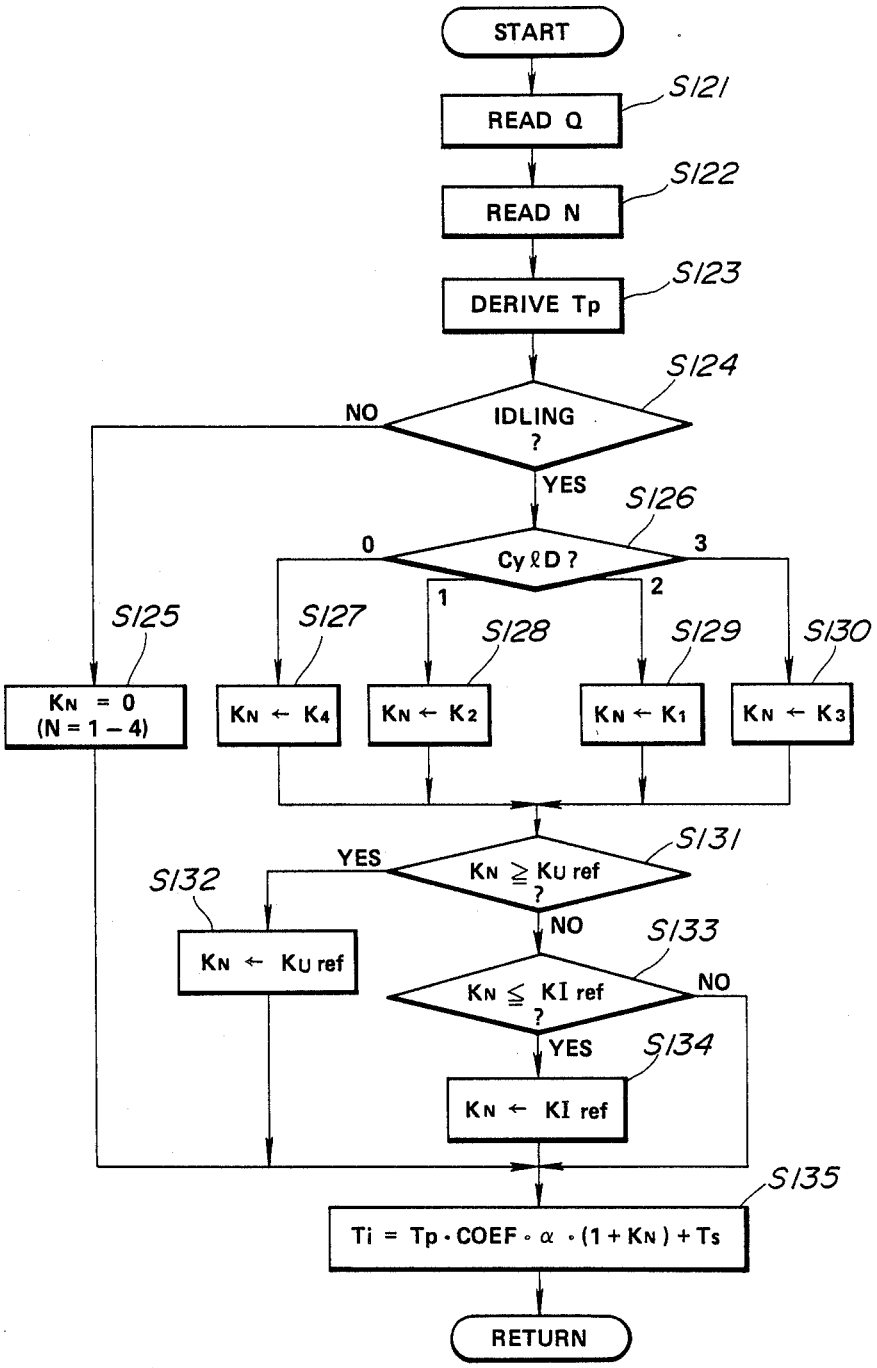
FIG. 15 is a flowchart of a fuel injection amount derivation routine to be executed by a control unit in the third embodiment of the fuel injection control system of FIG. 13.

FIGS. 14(A), 14(B) and 15 show the practical process of fuel injection control to be performed according to the third embodiment of the present invention. FIGS. 14(A) and 14(B) show the process for deriving the fuel injection amount correction value for respective engine cylinders. In the execution of the routine of FIGS. 14(A) and 14(B), various sensor signals as set out with respect to FIGS. 2 and 3, for example, are read out, at a step S90. At a step S91, the engine coolant temperature signal Tw is checked to determine whether the engine coolant temperature signal Tw represents an engine coolant temperature higher than or equal to a predetermined reference engine coolant temperature $TW_{ref}$, e.g., 80° C. If the engine coolant temperature Tw is lower than the predetermined reference engine coolant temperature $TW_{ref}$, the process goes to END and RETURN to a background job which may control various routines. On the other hand, when the engine coolant temperature Tw is higher than the predetermined reference engine coolant temperature $TW_{ref}$, the process goes to a step S92, in which the engine driving condition is checked to determine whether the engine is in an idling condition or not. If the engine is not in the idling condition as checked at the step S92, the process returns to the background job. On the other hand, when the engine is in an idling condition, the process goes to a step S93, in which the condition of air/fuel ratio control is checked in connection with the $O_2$ sensor signal. Namely, λ control (feedback control for the air/fuel ratio depending upon $O_2$ concentration in the exhaust gas) is performed when the $O_2$ sensor signal is HIGH which is indicative of an excessively rich mixture. While the λ control is active, a λ control indicative flag Fλcon is set in the control unit 100 at one '1'. When the λ control indicative flag Fλcon is set at '1', the process returns to the background job. On the other hand, when the λ control indicative flag is set at zero '0' which indicates that control is not active, the combustioning condition dependent fuel injection amount correction takes place through the steps subsequent to the step S93.

Namely, in summary, the combustioning condition dependent fuel injection amount correction takes place when the engine is sufficiently warmed-up, the engine is in idling condition and λ control is not active.

At a step S94, the crank reference signal $\theta$ is checked to determine whether the input crank reference signal represents 70° BTDC of the No. 1 cylinder or not. When the 70° BTDC of the No. 1 cylinder is detected at the step S94, the process goes to a step S95, at which a cylinder number data cylD is reset to 'zero (0)'. On the other hand, when the pulse width of the crank reference signal is smaller than the reference value, the process goes to a step S96. At the step S96, the cylinder indicative data cylD is incremented by one (1). Since the order of combustion in the cylinders is No.1-No.3-No.4-No.-2, the cylinder number '1', '2' and '3' respectively represent No. 3, No. 4 and No. 2 cylinders, as set forth above.

After the step S95 or S96, the cylinder number, to determine the fuel injection amount, is discriminated at a step S97. In practice, discrimination of the cylinder number is performed by checking the cylinder number indicative data cylD. Namely, when the cylinder number indicative data cylD is zero (0) it represents that the No. 1 cylinder approaches its TDC in compression stroke and thus the No. 4 cylinder approaches TDC at which the induction stroke starts. Therefore, the process goes to a step S98 to set the result of discrimination data n to 4 which indicates the cylinder number being No. 4 to determine the fuel injection amount. Similarly, when the cylinder number indicative data cylD is one (1), it represents that the No. 3 cylinder approaches its TDC in compression stroke and thus the No. 2 cylinder approaches TDC at which the induction stroke starts. Therefore, the process goes to a step S99 to set the result of discrimination data n to 2 indicative of the cylinder number being No. 2 to determine the fuel injection amount. When the cylinder number indicative data cylD is two (2), it represents that the No. 4 cylinder approaches its TDC in compression stroke and thus the No. 1 cylinder approaches TDC at which the induction stroke starts. Therefore, the process goes to a step S100 to set the result of discrimination data n to 1 indicative of the cylinder number being No. 1 to determine the fuel injection amount. Furthermore, when the cylinder number indicative data cylD is three (3), it represents that the No. 2 cylinder approaches its TDC in compression stroke and thus the No. 3 cylinder approaches TDC at which the induction stroke starts. Therefore, the process goes to a step S101 to set the result of discrimination data n to 3 indicative of the cylinder number being No. 3 to determine the fuel injection amount.

After one of the steps S98 to S101, the engine speed data $N_{old}$ and $N_{new}$ are read out. A reference value $(N_{new}+N_1)$ is calculated by adding the given engine speed difference criterion $N_1$ from the younger engine speed data $N_{old}$. The calculated value $(N_{new}+N_1)$ is compared with the older engine speed data $N_{old}$, at a step S102.

When the derived reference value $(N_{new}+N_1)$ is greater than the older engine speed data $N_{old}$, the process goes to a step S103. At the step S103, a correction enabling flag FGO which may be set in an appropriate flag register in the microprocessor based control unit of FIG. 3 though it is not distinctly shown, while the combustioning condition dependent fuel injection amount correction is enabled and reset while the fuel injection amount correction is disabled. When the correction enabling flag FGO is set to 'o' (reset), the process goes to END and returns to the background job. On the other hand, when the correction enabling flag FGO is set, the process goes to a step S104 in which a combustion counter L provided in the control unit 100, is incremented by '1'. Thereafter, the process returns to the background job.

On the other hand, when the reference value $(N_{new}+N_1)$ is smaller than or equal to the older engine speed data $N_{old}$, the process goes to a step S106 in which the correction enabling flag FGO is checked. When the correction enabling flag FGO is set to '1' (set), the combustioning condition dependent fuel injection amount correction value Kn is derived through subsequent steps S106 through S109.

In the process of derivation of the correction value Kn, the correction value Kn of the specific cylinder is incremented by 1% at a step S106. At the same step S106, the correction values Ki of other cylinders are also modified by subtracting $\frac{1}{3}$% from the precedingly set correction values Kn of respective other cylinders. After the process at the step S106, the correction value derived at the step S106 is compared with the predetermined maximum correction value $Kn_{max}$, e.g., 5%, at a step S107. When the derived correction value Kn is smaller than the maximum correction value $Kn_{max}$, the correction value Ki of other cylinders is compared with the predetermined minimum correction value $Kn_{min}$, e.g., 5% at a step S108. When the correction value Ki is greater than the minimum correction value $Kn_{min}$, the process returns to the background job.

On the other hand, when the correction value Kn of the specific cylinder, as checked at the step S107 is greater than or equal to the maximum correction value $Kn_{max}$, or when the correction value Ki of other cylinders, as checked at the step S108 is smaller than or equal to the minimum correction value $Kn_{min}$, the correction enabling flag FGO is reset to '0' at a step S109 After the step S109, the process returns to the background job.

When the correction enabling flag FGO is set at '0' as checked at the step S105, the process goes to a step S110, in which the combustion counter L is incremented by '1'. Thereafter, the correction value Kn of the specific cylinder is checked to determine whether the correction value Kn is smaller than zero (0), at a step S111. If the correction value Kn is greater than or equal to 0, the process returns to the background job. On the other hand, when the correction value Kn as checked at the step S111 is smaller than 0, a counter value $m_n$ of the mis-firing counter 302 is incremented by '1', at a step S112.

It should be noted that the mis-firing counter 302 shown in FIG. 13 has four blocks respectively for counting occurrence of the mis-firing in the corresponding engine cylinder. The mis-firing is assumed from a drop of the engine speed.

After the step S112, the combustion counter value L is compared with a maximum combustion counter value $L_{max}$, at a step S113. If the combustion counter value L is not equal to the maximum combustion counter value $L_{max}$, the process returns to the background job. On the other hand, when the combustion counter value L is equal to the maximum combustion counter value $L_{max}$, the combustion counter L is reset, at a step S114. After the step S114, mis-firing rate MFR is derived at a step S115. The mis-firing rate MFR is obtainable from:

$$MFR = 4 \times m_n / L_{max}$$

At the step S115, the derived mis-firing rate MFR is compared with a predetermined mis-firing rate threshold $MFR_{ref}$, e.g., 2%. When the mis-firing rate MFR becomes greater than or equal to the mis-firing rate threshold $MFR_{ref}$, the correction enabling flag FGO is set to '1' and the correction values Kn for all of the engine cylinders are reset, at a step S116. After this, the mis-firing counter 302 is reset to '0', at a step S117. On the other hand, when the mis-firing rate MFR as checked at the step S115 is smaller than the mis-firing threshold $MFR_{ref}$, the process directly goes to the step S117 jumping the step S116.

Based on the correction values derived as set forth above, a fuel injection amount is determined for respective cylinders in synchronism with engine revolution according to the process shown in FIG. 15.

Immediately after starting execution of the shown routine, the air flow rate indicative signal value Q is read out at a step S121 and subsequently the engine speed data N is read out at a step S122. In practice, the engine speed data N is read from the address block 162 of RAM. Based on the air flow rate indicative signal value Q and the engine speed data N read out at the steps S121 and S122, the basic fuel injection amount Tp is calculated according to the foregoing and known equation ($Tp = K \times Q/N$), at a step S123.

After the step S123 an engine driving condition is checked at a step S124 to determine whether the engine is in the idling condition or not. When the engine is not in the idling condition, the process goes to a step S125, in which the fuel injection amount correction values Kn of respective cylinders are set to zero (0).

On the other hand, when the engine idling condition is detected at the step S124, the cylinder number to determine the fuel injection amount is discriminated at a step S126. In practice, discrimination of the cylinder number is performed by checking the cylinder number indicative data cylD. Namely, when the cylinder number indicative data cylD is zero (0), it represents that the No. 1 cylinder approaches its TDC in compression stroke and thus the No. 4 cylinder approaches TDC at which the induction stroke starts. Therefore, the process goes to a step S127 to set the result of discrimination data n to 4 which indicates the cylinder number being No. 4 to determine the fuel injection amount. Similarly, when the cylinder number indicative data cylD is one (1), it represents that the No. 3 cylinder approaches its TDC in compression stroke and thus the No. 2 cylinder approaches TDC at which the induction stroke starts. Therefore, the process goes to a step S128 to set the result of discrimination data n to 2 indicative of the cylinder number being No.2 to determine the fuel injection amount. When the cylinder number indicative data cylD is two (2), it represents that the No. 4 cylinder approaches its TDC in compression stroke and thus the No. 1 cylinder approaches TDC at which the induction stroke starts. Therefore, the process goes to a step S129 to set the result of discrimination data n to 1 indicative of the cylinder number being No.1 to determine the fuel injection amount. Furthermore, when the cylinder number indicative data cylD is three (3), it represents that the No. 2 cylinder approaches its TDC in compression stroke and thus the No. 3 cylinder approaches TDC at which the induction stroke starts. Therefore, the process goes to a step S130 to set the result of discrimination data n to 3 indicative of the cylinder number being No. 3 to determine the fuel injection amount.

The discriminated data n is read at a step S131 in order to identify the cylinder number about which the fuel injection amount is to be derived. The read discriminated data n is also used as identification of the memory addresses 164, 166, 168 and 170. It should be noted that, in the shown embodiment, the memory addresses 164, 166, 168 and 170 are designed to store the correction value Kn as an actual value instead of the correction demand indicative flag. Based on the read discriminated data n, CPU 130 outputs the address signal identifying the corresponding memory address. At the step S131, one of the memory blocks 164, 166, 168 and 170 is accessed to read out the fuel amount correction value Kn set in the corresponding memory block.

The read correction value Kn is compared with an upper reference value $Kn_{uref}$ which represents a value smaller than the maximum correction value $Kn_{max}$, at a step S131. If the correction value Kn is greater than or equal to the upper reference value $Kn_{uref}$ as checked at the step S131, the process goes to a step S132 to modify the correction value to the upper reference value $Kn_{uref}$. On the other hand, when the correction value Kn is smaller than the upper reference value $Kn_{uref}$ as checked at the step S131, the process goes to a step S133 to compare the correction value Kn with a lower reference value $Kn_{lref}$ which is greater than the minimum correction value $Kn_{min}$. If the correction value Kn is smaller than or equal to the lower reference value $Kn_{lref}$, as checked at the step S133, the correction value Kn is modified to the lower reference value $K_{lref}$, at a step S134.

When the correction value Kn is greater than the lower reference value $Kn_{lref}$ or after the steps of S132 or S134, the process goes to a step S135. At the step S135, arithmetic operation is performed to derive the corrected fuel injection amount Ti according to the following equation:

$$Ti = Tp \times COEF \times \alpha(1+Kn) + Ts$$

at a step S135. The derived fuel injection amount Ti is set in one of memory blocks 172, 174, 176 and 178 in RAM.

Based on the derived fuel injection amount Ti, the fuel injection is performed by executing the fuel injection control routine which is identical to that discussed with respect FIG. 8.

As will be appreciated herefrom, the fuel injection control system is successful in suppressing fluctuation of the combustioning condition in each engine cylinder to provide uniform engine driving characteristics and performance.

Therefore, the invention fulfills all of the objects and advantages sought therefor.

While the present invention has been disclosed in terms of preferred embodiments in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A fuel supply control system for an internal combustion engine which has a plurality of engine cylinders, comprising:

first means for delivering a controlled amount of fuel for respective engine cylinders at mutually independent and controlled timing;

second means for monitoring a preselected engine driving condition and producing an engine driving condition indicative signal;

third means for deriving a fuel delivery amount for respective engine cylinders on the basis of the value of said engine driving condition indicative signal;

fourth means for monitoring engine speed variation for detecting fluctuation of combustioning conditions between respective engine cylinders;

fifth means, responsive to the fluctuation of the combustioning condition in excess of a predetermined magnitude, to derive a first correction value for correcting said fuel delivery amount for one of said engine cylinders, based thereon;

sixth means for deriving a second correction value for correcting said fuel delivery amount for other engine cylinders;

seventh means for comparing said correction value with predetermined threshold values for disabling derivation of said correction value when said correction value becomes greater than or smaller than said predetermined threshold values; and eighth means for controlling said first means at said controlled timing for delivering the fuel in the controlled amount corresponding to the fuel delivery amount corrected by said fifth means.

2. A fuel supply control system for an internal combustion engine which has a plurality of engine cylinders, comprising:

first means for delivering a controlled amount of fuel for respective engine cylinders at mutually independent and controlled timing;

second means for monitoring a preselected engine driving condition and for producing an engine driving condition indicative signal;

third means for deriving a fuel delivery amount for respective engine cylinders on the basis of the value of said engine driving condition indicative signal;

fourth means for monitoring engine speed variation for detecting a fluctuation of combustioning conditions between respective engine cylinders;

fifth means, responsive to the fluctuation of the cumbustioning condition in excess of a predetermined magnitude, to derive a correction value for correcting said fuel delivery amount based thereon; said fifth means comparing said correction value with a predetermined value to detect whether said correction value is within a given value range for modifying the correction value to have a value corresponding to said predetermined value when said correction value is out of said given range; and sixth means for controlling said first means at said controlled timing for delivering the fuel in the controlled amount corresponding to the fuel delivery amount corrected by said fifth means.

3. A fuel supply control system as set forth in claim 2, wherein said fifth means compares said correction value with a first predetermined value defining the upper limit of said given range and with a second predetermined value defining the lower limit of said given range so that the correction value greater than said first predetermined value is modified to be said first predetermined value and the correction value smaller than said second predetermined value is modified to be said second predetermined value.

4. A fuel supply control system as set forth in claim 2, wherein said fifth means derives said correction value for each engine cylinder depending upon the combustioning condition thereof.

5. A fuel supply control system for an internal combustion engine which has a plurality of engine cylinders, comprising:

first means for delivering a controlled amount of fuel for respective engine cylinders at mutually independent and controlled timing;

second means for monitoring a preselected engine driving condition and producing an engine driving condition indicative signal;

third means for delivering a fuel delivery amount for respective engine cylinders on the basis of the value of said engine driving condition indicative signal;

fourth means for monitoring engine speed variation for detecting fluctuation of combustioning conditions between respective engine cylinders;

fifth means, respective to the fluctuation of combustioning condition in excess of a predetermined magnitude, to derive a correction value for correcting said fuel delivery amount based thereon;

sixth means for comparing said correction value with predetermined threshold values for disabling derivation of said correction value when said correction value becomes greater than or smaller than said predetermined threshold values; and seventh means for controlling said first means at said controlled timing for delivering the fuel in the controlled amount corresponding to the fuel delivery amount corrected by said fifth means.

6. A fuel supply control system as set forth in claim 5, wherein said sixth means comprises a first correction means, responsive to the fluctuation of the cumbustioning condition in excess of a predetermined magnitude for deriving a first correction value for correcting said fuel delivery amount for one of said engine cylinders, based thereon, and a second correction means for deriving a second correction value for correcting said fuel delivery amount for other engine cylinders.

7. A fuel supply control system as set forth in claim 6, which further comprises an eighth means for detecting occurrence of fluctuation of combustioning condition exceeding said predetermined magnitude causing a drop of engine speed and counting said occurrence to resume derivation of said correction value when said counted value of said occurrence exceeds a given value.

8. A fuel supply control system as set forth in claim 7, wherein said first and second correction means of said sixth means compare said first and second correction values with a predetermined value to detect whether said correction value is within a given value range for modifying the correction value to have a value corresponding to said predetermined value when said correction value is out of said given range.

9. A fuel supply control system as set forth in claim 8, wherein said first and second correction means compare said first and second correction values with a first predetermined value defining the upper limit of said given range and with a second predetermined value defining the lower limit of said given range so as to disable operation of said first and second correction means when one of said first and second correction values becomes greater than said first predetermined value or when one of said first and second correction values becomes smaller than said second predetermined value.

10. A fuel supply control system for an internal combustion engine which has a plurality of engine cylinders, comprising:

first means for delivering a controlled amount of fuel for respective engine cylinders at mutually independent and controlled timing;

second means for monitoring a preselected engine driving condition and producing an engine driving condition indicative signal;

third means for deriving a fuel delivery amount for respective engine cylinders on the basis of the value of said engine driving condition indicative signal;

fourth means for monitoring engine speed variation for detecting fluctuation of combustioning conditions between respective engine cylinders;

fifth means, responsive to the fluctuation of the combustioning condition in excess of a predetermined magnitude, to derive a correction value for correcting said fuel delivery amount based thereon; and sixth means for controlling said first means at said controlled timing for delivering the fuel in the controlled amount corresponding to the fuel delivery amount corrected by said fifth means.

11. A fuel supply control system as set forth in claim 10, wherein said fifth means derives said correction value for each engine cylinder depending upon the combustioning condition thereof.

12. A fuel supply control system as set forth in claim 10, which further comprises seventh means for detecting timing of occurrence of combustion in each of said engine cylinders and identifying the combustioning engine cylinder, and wherein said fourth means monitors engine speed variation in intervals between combustion timing to detect fluctuation of combustioning conditions between subsequently combustioning engine cylinders based on said engine speed variation.

13. A fuel supply control system as set forth in claim 12, wherein said fifth means comprises a first correction means, responsive to the fluctuation of the combustioning condition in excess of a predetermined magnitude, for deriving a first correction value for correcting said fuel delivery amount for one of said engine cylinders, based thereon, and a second correction means for deriving a second correction value for correcting said fuel delivery amount for other engine cylinders.

14. A fuel supply control system as set forth in claim 13, wherein said second correction means derives said second correction value to reduce the fuel delivery amount for said other cylinders when said first correction value derived by said first correction means orders increasing of the fuel delivery amount for said one of cylinders, and to increase the fuel delivery amount for said other cylinders when said first correction value orders reducing of the fuel delivery amount for said one of cylinders.

15. A fuel supply control system as set forth in claim 13, wherein said second correction means derives said second correction value by distributing a value corresponding to said first correction value in such a manner that said second correction value orders to reduce the fuel delivery amount for said other cylinders when said first correction value derived by said first correction means orders increasing of the fuel delivery amount for said one of cylinders, and to increase the fuel delivery amount for said other cylinders when said first correction value orders reducing of the fuel delivery amount for said one of cylinders.

16. A fuel supply control system as set forth in claim 10, which further comprises a means for comparing said correction value with a predetermined threshold value for disabling derivation of said correction value when said correction value becomes greater than or smaller than said predetermined threshold value.

17. A fuel supply control system as set forth in claim 16, which further comprises a seventh means for detecting occurrence of fluctuation of combustioning condition exceeding said predetermined magnitude causing drop of engine speed and counting said occurrence to resume derivation of said correction value when said counted value of said occurrence exceeds a given value.

18. A fuel supply control system as set forth in claim 17, wherein said fifth means comprises a first correction means, responsive to the fluctuation of the combustioning condition in excess of a predetermined magnitude, for deriving a first correction value for correcting said fuel delivery amount for one of said engine cylinders, based thereon, and a second correction means for deriving a second correction value for correcting said fuel delivery amount for other engine cylinders.

19. A fuel supply control system as set forth in claim 18, wherein said first and second correction means of said fifth means compare said first and second correction values with a predetermined value to detect whether said correction value is within a given value range for modifying the correction value to have a value corresponding to said predetermined value when said correction value is out of said given range.

20. A fuel supply control system as set forth in claim 19, wherein said first and second correction means compare said first and second correction values with a first predetermined value defining the upper limit of said given range and with a second predetermined value defining the lower limit of said given range so as to disable operation of said first and second correction means when one of said first and second correction values becomes greater than said first predetermined value or when one of said first and second correction values becomes smaller than said second predetermined value.

21. A fuel supply control system as set forth in claim 20, which further comprises an eighth means which compares said first and second correction values with a third predetermined value which is smaller than said first predetermined value, and a fourth predetermined value which is greater than said second predetermined value so that when one of said first and second correction values is greater than said third predetermined value, the corresponding one of said first and second correction values is modified to be said third predetermined value, and when one of said first and second correction values is smaller than said second predetermined value, the corresponding one of said first and second correction values is modified to be said second predetermined value.

22. A fuel supply control system for an internal combustion engine which has a plurality of engine cylinders, comprising:

first means for delivering a controlled amount of fuel for respective engine cylinders at mutually independent and controlled timing;

second means for monitoring a preselected engine driving condition and producing an engine driving condition indicative signal;

third means for deriving a fuel delivery amount for respective engine cylinders on the basis of the value of said engine driving condition indicative signal;

fourth means for monitoring engine speed variation for detecting fluctuation of combustioning conditions between respective engine cylinders;

fifth means, responsive to the fluctuation of the combustioning condition in excess of a predetermined magnitude, to derive a first correction value for correcting said fuel delivery amount for one of said engine cylinders, based thereon;

sixth means for deriving a second correction value for correcting said fuel delivery amount for other engine cylinders; and seventh means for controlling said first means at said controlled timing for delivering the fuel in the controlled amount corresponding to the fuel delivery amount corrected by said fifth means.

23. A fuel supply control system as set forth in claim 22, wherein said second correction means derives said second correction value to reduce the fuel delivery amount for said other cylinders when said first correction value derived by said first correction means orders increasing of the fuel delivery amount for said one of cylinders, and to increase the fuel delivery amount for said other cylinders when said first correction value orders reducing of the fuel delivery amount for said one of cylinders.

24. A fuel supply control system as set forth in claim 22, wherein said second correction means derives said second correction value by distributing a value corresponding to said first correction value in such a manner that said second correction value orders to reduce the fuel delivery amount for said other cylinders when said first correction value derived by said first correction means orders increasing of the fuel delivery amount for said one of cylinders, and to increase the fuel delivery amount for said other cylinders when said first correction value orders reducing of the fuel delivery amount for said one of cylinders.

25. A fuel supply control system as set forth in claim 22, wherein said fifth and sixth means compare said first and second correction values with a predetermined value to detect whether said correction value is within a given value range for modifying the correction value to have a value corresponding to said predetermined value when said correction value is out of said given range.

26. A fuel supply control system as set forth in claim 22, wherein said fifth means compares said correction value with a predetermined value to detect whether said correction value is within a given value range for modifying the correction value to have a value corresponding to said predetermined value when said correction value is out of said given range.

27. A fuel supply control system as set forth in claim 26, wherein said fifth means compares said correction value with a first predetermined value defining the upper limit of said given range and with a second predetermined value defining the lower limit of said given range so that the correction value greater than said first predetermined value is modified to be said first predetermined value and the correction value smaller than said second predetermined value is modified to be said second predetermined value.

28. A fuel supply control system as set forth in claim 27, wherein said fifth means derives said correction value for each engine cylinder depending upon the combustioning condition thereof.

29. A fuel supply control system as set forth in claim 22, which further comprises an eighth means for comparing said correction value with predetermined threshold values for disabling derivation of said correction value when said correction value becomes greater than or smaller than said predetermined threshold values.

30. A fuel supply control system as set forth in claim 29, which further comprises a ninth means for detecting occurrence of fluctuation of combustioning condition exceeding said predetermined magnitude causing a drop of engine speed and counting said occurrence to resume derivation of said correction value when said counted value of said occurrence exceeds a given value.

31. A fuel supply control system as set forth in claim 30, wherein said fifth and sixth means compare said first and second correction values with a predetermined value to detect whether said correction value is within a given value range for modifying the correction value to have a value corresponding to said predetermined value when said correction value is out of said given range.

32. A fuel supply control system as set forth in claim 31, wherein said fifth and sixth means compare said first and second correction values with a first predetermined value defining the upper limit of said given range and with a second predetermined value defining the lower limit of said given range so as to disable operation of said first and second correction means when one of said first and second correction values becomes greater than said first predetermined value or when one of said first and second correction values becomes smaller than said second predetermined value.

33. A fuel supply control system as set forth in claim 32, which further comprises eighth means which compares said first and second correction values with a third predetermined value which is smaller than said first predetermined value, and a fourth predetermined value which is greater than said second predetermined value so that when one of said first and second correction values is greater than said third predetermined value, the corresponding one of said first and second correction values is modified to be said third predetermined value, and when one of said first and second correction values is smaller than said second predetermined value, the corresponding one of said first and second correction values is modified to be said second predetermined value.

34. A fuel supply control system as set forth in claim 32, which further comprises a ninth means which compares said first and second correction values with a third predetermined value which is smaller than said first predetermined value, and a fourth predetermined value which is greater than said second predetermined value so that when one of said first and second correction values is greater than said third predetermined value, the corresponding one of said first and second correction values is modified to be said third predetermined value, and when one of said first and second correction values is smaller than said second predetermined value, the corresponding one of said first and second correction values is modified to be said second predetermined value.

* * * * *